US008367933B1

(12) United States Patent
Mumm et al.

(10) Patent No.: US 8,367,933 B1
(45) Date of Patent: Feb. 5, 2013

(54) DATA CABLES WITH IMPROVED PAIR PROPERTY BALANCE

(75) Inventors: Jeffrey H. Mumm, Marietta, GA (US); Justin W. Mintz, Hoisington, KS (US); Nathaniel Ostrander, Woodstock, GA (US)

(73) Assignee: Superior Essex Communications LP, Atlanta, GA (US)

( * ) Notice: Subject to any disclaimer, the term of this patent is extended or adjusted under 35 U.S.C. 154(b) by 229 days.

(21) Appl. No.: 12/803,119

(22) Filed: Jun. 18, 2010

Related U.S. Application Data

(60) Provisional application No. 61/269,075, filed on Jun. 19, 2009.

(51) Int. Cl.
*H01B 11/02* (2006.01)

(52) U.S. Cl. ..... 174/113 R

(58) Field of Classification Search ..... 174/113 R, 174/113 C, 110 F
See application file for complete search history.

(56) References Cited

U.S. PATENT DOCUMENTS

| | | | |
|---|---|---|---|
| 3,945,974 | A | 3/1976 | Schwarcz et al. |
| 4,412,094 | A | 10/1983 | Dougherty et al. |
| 5,162,609 | A | 11/1992 | Adriaenssens et al. |
| 5,270,486 | A | 12/1993 | Chan et al. |
| 5,493,071 | A | 2/1996 | Newmoyer |
| 5,514,837 | A | 5/1996 | Kenny et al. |
| 5,576,515 | A | 11/1996 | Bleich et al. |
| 5,597,981 | A | 1/1997 | Hinoshita et al. |
| 5,770,820 | A | 6/1998 | Nelson et al. |
| 5,841,073 | A | 11/1998 | Randa et al. |
| RE37,010 | E | 1/2001 | Newmoyer |
| 7,030,321 | B2 | 4/2006 | Clark |
| 7,084,348 | B2 | 8/2006 | Dillon |

FOREIGN PATENT DOCUMENTS

JP 2010-123275 * 6/2010

* cited by examiner

*Primary Examiner* — Chau Nguyen

(57) ABSTRACT

A communication cable can comprise twisted pairs of electrical conductors for transmitting electrical signals, such as for digital communication or data transmission. The pairs can be twisted to different lengths, thereby managing interference among the pairs. The electrical conductors of the pairs can be individually insulated with a polymeric material comprising a base polymer that is foamed with a gas such as nitrogen. The respective foaming levels of the electrical conductors in each pair can be selected to balance electrical properties among the pairs.

25 Claims, 29 Drawing Sheets

| CONDUCTORS | | | | | | | | |
|---|---|---|---|---|---|---|---|---|
| Insulation Material | HDPE | | | | | | | |
| | | | | | | | | |
| Conductor Material | Cu | | | | | | | |
| Pair Twist Direction | LHL | | | | | | | |
| | BL | BL/WH | OR | OR/WH | GR | GR/WH | BR | BR/WH |
| Insulation Diameter, in | 0.04545 | 0.04505 | 0.04518 | 0.04523 | 0.04504 | 0.04514 | 0.04557 | 0.04535 |
| Pair Insulation Weight, g/ft | 0.436 | | 0.472 | | 0.437 | | 0.478 | |
| Conductor Diameter, in | 0.02256 | 0.02258 | 0.02266 | 0.02267 | 0.02251 | 0.02254 | 0.02265 | 0.02262 |
| Copper weight, g/ft | 1.5300 | | 1.5030 | | 1.5430 | | 1.5110 | |
| Pair Twist Lay Sample 1, twist/in | 2.9580 | | 2.2740 | | 3.2080 | | 2.4830 | |
| Pair Twist Lay Sample 1, in./twist | 0.3381 | | 0.4398 | | 0.3117 | | 0.4027 | |
| Pair Twist Lay Sample 2, twist/in | 2.9490 | | 2.2830 | | 3.2080 | | 2.4910 | |
| Pair Twist Lay Sample 2, in./twist | 0.3391 | | 0.4380 | | 0.3117 | | 0.4014 | |
| Pair Twist Lay Sample 3, twist/in | 2.9580 | | 2.2990 | | 3.2160 | | 2.4830 | |
| Pair Twist Lay Sample 3, in./twist | 0.3381 | | 0.4350 | | 0.3109 | | 0.4027 | |
| *Average twist/in* | *2.9550* | | *2.2853* | | *3.2107* | | *2.4857* | |
| *Average in./twist* | *0.3384* | | *0.4376* | | *0.3115* | | *0.4023* | |
| Diameter over Pair, in | *.04956/.08904* | | *.05243/.09086* | | *.05044/.08756* | | *.05276/.08898* | |

*Fig. 5A*

| JACKET | | | | | | | |
|---|---|---|---|---|---|---|---|
| Jacket Print per 10ft | 5 | | 1 | 2 | 3 | Average | |
| Jacket Material | JJC31-L | Jacket Diameter, in. | 0.2976 | 0.3041 | 0.3005 | 0.3007 | |
| Jacket Product ID or Part Number | 960133021 | FOD over Shield, in. | 0.2488 | 0.2499 | 0.2438 | 0.2475 | |
| Jacket Color | Blue | FOD over Core, in. | 0.2196 | 0.2155 | 0.2176 | 0.2176 | |
| Jacket Weight, g/ft | 6.917 | Jacket Thickness, in. | 0.0230 | 0.0249 | 0.0241 | 0.0240 | |
| **FILLER/CORE** | | | | | | | |
| X-Filler Material | Foamed FRPE | FILLER | Leg 1 | Leg 2 | Leg 3 | Leg 4 | Average |
| | | Tip, in. | 0.0174 | 0.0174 | 0.0171 | 0.0170 | 0.0172 |
| Crossfiller Weight in Air | 0.1027 | Mid-Point, in. | 0.0244 | 0.0247 | 0.0246 | 0.0239 | 0.0244 |
| Crossfiller Weight in Water | 0.1055 | Base, in. | 0.0270 | 0.0265 | 0.0270 | 0.0274 | 0.0270 |
| Crossfiller Density | 0.97 | Fin Length, in. | 0.0653 | 0.0626 | 0.0615 | 0.0599 | 0.0623 |
| Crossfiller Weight, g/ft | 1.258 | | Leg (1 to 3) | | Leg (2 to 4) | | |
| Core Twist Lay, twist/10ft | 24 | Width, in. | 0.1537 | | 0.1550 | | 0.1544 |
| in./twist | 5.0000 | | Width 1 | | Width 2 | | |
| Core Twist Direction | LHL | Crossection, in. | 0.0420 | | 0.0430 | | 0.0425 |

*Fig. 5B*

| | | Measured (in) | | | |
|---|---|---|---|---|---|
| Test | *Average (in)* | 1 | 2 | 3 | 4 |
| FOD Outer Jkt | *0.3968* | 0.3949 | 0.4004 | 0.3952 | |
| FOD Inner Jkt | *0.26040* | 0.2793 | 0.2808 | 0.2811 | |
| ID Outer Jkt | *0.3181* | 0.3194 | 0.3170 | 0.3178 | |
| ID Inner Jkt | *0.23443* | 0.2359 | 0.2362 | 0.2312 | |
| Outer Jkt Thickness | *0.0327* | 0.0333 | 0.0322 | 0.0327 | 0.0347 |
| Inner Jkt Thickness | *0.02200* | 0.0221 | 0.0216 | 0.0216 | 0.0227 |
| Shield Overlap | *0.12267* | 0.1194 | 0.1202 | 0.1284 | |

Print count/10ft = 5

| LHL | (lay/10 ft) | (in/lay) |
|---|---|---|
| Bunch Lay | 23 | 5.22 |

| LHL Twin Lay | (lay/in) | (in/lay) |
|---|---|---|
| Blue | 2.833 | 0.3530 |
| Orange | 2.116 | 0.4726 |
| Green | 3.108 | 0.3218 |
| Brown | 2.258 | 0.4429 |

| | Diameter (in) | |
|---|---|---|
| | Insulation | Copper |
| Blue | 0.04246 | 0.02276 |
| White | 0.04235 | 0.02273 |
| Orange | 0.04263 | 0.02292 |
| White | 0.04269 | 0.02295 |
| Green | 0.04244 | 0.02270 |
| White | 0.04247 | 0.02278 |
| Brown | 0.04255 | 0.02291 |
| White | 0.04274 | 0.02290 |

*Fig. 9A*

Crossweb Dimensions

| Width | Inches |
|---|---|
| W1 | 0.0382 |
| W2 | 0.0348 |
| **Thickness** | **Inches** |
| 1 Top | 0.0105 |
| 1 Bottom | 0.0217 |
| 2 Top | 0.0103 |
| 2 Bottom | 0.0207 |
| 3 Top | 0.0108 |
| 3 Bottom | 0.0204 |
| 4 Top | 0.0121 |
| 4 Bottom | 0.0209 |

| | Skin Thickness (in) | | | | |
|---|---|---|---|---|---|
| **Insulation** | **1** | **2** | **3** | **4** | **Avg** |
| Blue | 0.00406 | 0.00283 | 0.00350 | 0.00319 | *0.00340* |
| White | 0.00287 | 0.00347 | 0.00291 | 0.00346 | *0.00318* |
| Green | 0.00406 | 0.00268 | 0.00378 | 0.00318 | *0.00343* |
| White | 0.00346 | 0.00362 | 0.00315 | 0.00327 | *0.00338* |

*Fig. 9B*

Density by Density Scale:

| Sample | A (g) (Weight in Air) | P (g) (Weight in Water) | Density (g/cm$^3$) |
|---|---|---|---|
| BL Conductor | 5.4118 | 0.6067 | |
| BL Insulated Conductor | 6.6306 | 2.0914 | |
| BL Insulation | 1.2188 | 1.4847 | 0.8209 |
| BL/WH Conductor | 5.4057 | 0.6061 | |
| BL/WH Insulated Conductor | 6.6630 | 2.0859 | |
| BL/WH Insulation | 1.2573 | 1.4798 | 0.8496 |
| GR Conductor | 5.4374 | 0.6098 | |
| GR Insulated Conductor | 6.6956 | 2.1258 | |
| GR Insulation | 1.2582 | 1.5160 | 0.8299 |
| GR/WH Conductor | 5.4492 | 0.6136 | |
| GR/WH Insulated Conductor | 6.7114 | 2.1144 | |
| GR/WH Insulation | 1.2622 | 1.5008 | 0.8410 |

*Density = A / P * Density of Water [g/cm$^3$]

*Fig. 9C*

DATA CABLES WITH IMPROVED PAIR PROPERTY BALANCE

CROSS REFERENCE TO RELATED APPLICATIONS

This application claims priority to U.S. Provisional Patent Application No. 61/269,075, filed on Jun. 19, 2009 in the name of Jeffrey H. Mumm, Justin W. Mintz, and Nathanial F. Ostrander and entitled "Data Cables with Improved Pair Property Balance," the entire contents of which are hereby incorporated herein by reference.

FIELD OF THE TECHNOLOGY

The present invention relates to communication cables comprising multiple twisted pairs of electrical conductors for transmitting communication signals, and more specifically to cables in which the pairs are twisted at different rates and insulated with a polymer that is foamed according to the twist length.

BACKGROUND

As the desire for enhanced communication bandwidth escalates, transmission media are pressed to convey information at higher speeds while maintaining signal fidelity and avoiding crosstalk. For example, a single communication cable may be called upon to transmit multiple communication signals over respective electrical conductors concurrently. Such a communication cable may have two or more twisted pairs of insulated electrical conductors ("twisted pairs"), each twisted to a different twist length or "lay length." The twisted pairs may be imparted with different lay lengths in order to control interference associated with signal energy coupling between or among the pairs.

For a specific length of cable, a pair that is more tightly twisted has a longer signal path length than a pair that is less tightly twisted. Accordingly, signals traveling on different twisted pairs can take different amounts of time to traverse a cable. Such pair-to-pair variation in propagation delay, known as "skew," can negatively impact cable performance. For example, cable purchasers may specify a maximum level of skew that is acceptable. Additionally, a pair that is more tightly twisted typically has a greater level of insertion loss or attenuation over a fixed cable length than a pair twisted more loosely.

One conventional proposal for addressing attenuation differences among twisted pairs within a cable involves varying insulation thickness among pairs according to pair twist. However, this approach to addressing variations in pair-to-pair attenuation often creates issues with inequality of pair-to-pair impedance and propagation speed. Such pair-to-pair imbalance can lead to cable-to-component mismatches and return loss problems, as well as incompatibilities with components of a communication system connected to the cable.

Accordingly, need exists for a technology that can enhance signal performance of a cable that comprises twisted pairs, including but not limited to improving pair balance, insertion loss, skew, attenuation, and/or crosstalk. A capability addressing such need or some other related deficiency in the art would elevate bandwidth that a communication cable can carry reliably.

SUMMARY

In one aspect of the present invention, a communication cable can comprise multiple electrical conductors for transmitting multiple communication signals concurrently. The communication signals can comprise digital or discrete signal levels supporting digital communication, for example. The communication cable can comprise twisted pairs of insulated electrical conductors that extend lengthwise along the cable. The pairs can be twisted to different lengths towards controlling or avoiding interference among the twisted pairs. While benefiting interference performance, the different twist lengths can affect electrical performance of the twisted pairs, such that each pair having a different twist length may have one or more different electrical performance characteristics. To compensate for such differences in electrical performance, the insulation of each twisted pair can be foamed according to the particular twist length of that pair. Accordingly, the respective foaming levels of the electrical conductors in each twisted pair can be selected to balance electrical properties among the twisted pairs.

The discussion of balancing electrical properties of twisted pairs by foaming insulation according to twist length is for illustrative purposes only. Various aspects of the present invention may be more clearly understood and appreciated from a review of the following detailed description of the disclosed embodiments and by reference to the drawings and the claims that follow. Moreover, other aspects, systems, methods, features, advantages, and objects of the present invention will become apparent to one with skill in the art upon examination of the following drawings and detailed description. It is intended that all such aspects, systems, methods, features, advantages, and objects are to be included within this description, are to be within the scope of the present invention, and are to be protected by the accompanying claims.

BRIEF DESCRIPTION OF THE DRAWINGS

FIGS. 5A and 5B, collectively FIG. 5, is a table containing construction details for an exemplary communication cable in accordance with certain embodiments of the present invention.

FIG. 6, are plots of exemplary characteristic impedance data obtained via laboratory testing of a communication cable constructed according to the design details provided in FIG. 5 in accordance with certain embodiments of the present invention.

FIG. 7, are plots of exemplary propagation delay data obtained via laboratory testing of a communication cable constructed according to the design details provided in FIG. 5 in accordance with certain embodiments of the present invention.

FIG. 8, are plots of exemplary propagation delay skew data obtained via laboratory testing of a communication cable constructed according to the design details provided in FIG. 5 in accordance with certain embodiments of the present invention.

FIGS. 9A, 9B, and 9C, collectively FIG. 9, is a table containing construction details for an exemplary communication cable in accordance with certain embodiments of the present invention.

FIG. 9, are plots of exemplary characteristic impedance data obtained via laboratory testing of a communication cable constructed according to the design details provided in FIG. 10 in accordance with certain embodiments of the present invention.

FIG. 9, are plots of exemplary propagation delay data obtained via laboratory testing of a communication cable constructed according to the design details provided in FIG. 11 in accordance with certain embodiments of the present invention.

FIG. 9, are plots of exemplary propagation delay skew data obtained via laboratory testing of a communication cable constructed according to the design details provided in FIG. 12 in accordance with certain embodiments of the present invention.

Figure 1:
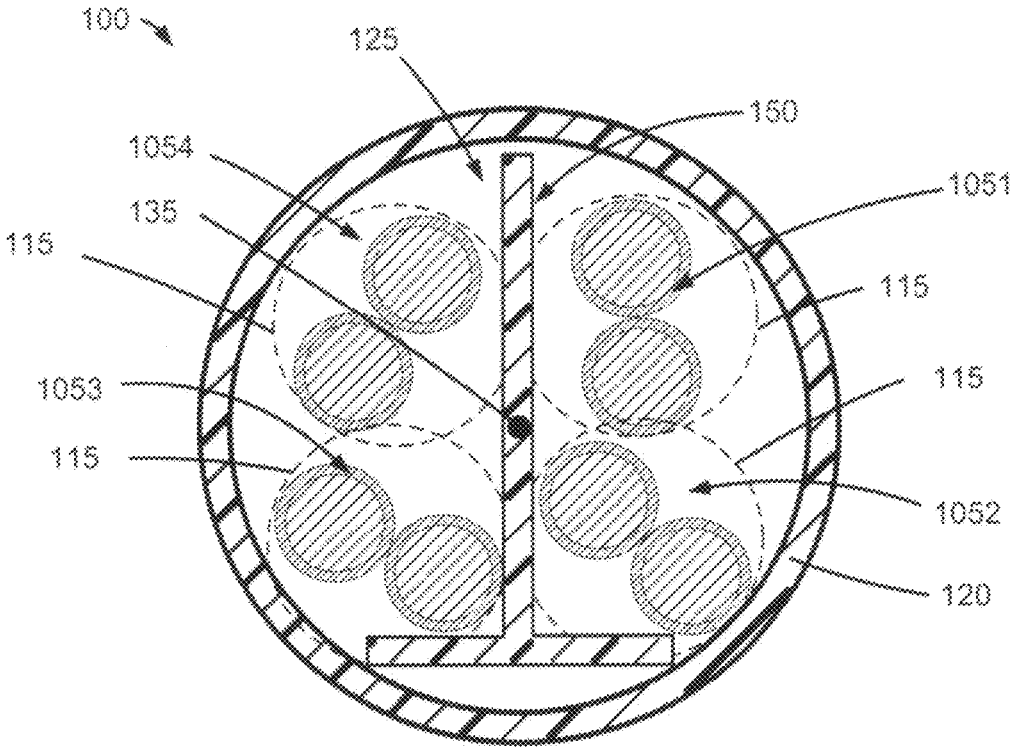
FIG. 1 is a cross sectional view of an exemplary communication cable that comprises four twisted pairs of electrical conductors, each covered with an insulation that is foamed according to twist lay length of its associated pair, in accordance with certain embodiments of the present invention.

Many aspects of the invention can be better understood with reference to the above drawings. The elements and features shown in the drawings are not to scale, emphasis instead being placed upon clearly illustrating the principles of exemplary embodiments of the present invention. Moreover, certain dimensions may be exaggerated to help visually convey such principles. In the drawings, reference numerals designate like or corresponding, but not necessarily identical, elements throughout the several views.

DETAILED DESCRIPTION OF EXEMPLARY EMBODIMENTS

Technology for managing electrical properties of and/or among twisted pairs of a communication cable will now be described more fully with reference to FIGS. 1-12, which describe representative embodiments of the present invention. FIGS. 1, 2, 3, and 4 describe exemplary features of a communication cable comprising foamed electrical insulation that balances electrical performance among twisted pairs. FIGS. 5, 6, 7, and 8 describe an example of a fabricated and laboratory tested embodiment of a communication cable comprising foamed electrical insulation that balances electrical performance among twisted pairs. FIGS. 9, 10, 11, and 12 describe another example of a fabricated and laboratory tested embodiment of a communication cable comprising foamed electrical insulation that balances electrical performance among twisted pairs.

The invention can be embodied in many different forms and should not be construed as limited to the embodiments set forth herein; rather, these embodiments are provided so that this disclosure will be thorough and complete, and will fully convey the scope of the invention to those having ordinary skill in the art. Furthermore, all "examples" or "exemplary embodiments" given herein are intended to be non-limiting and among others supported by representations of the present invention.

Turning now to FIG. 1, this figure illustrates a cross sectional view of an communication cable 100 that comprises four twisted pairs 105 (1051, 1052, 1053, 1054) of electrical conductors, each covered with an insulation that is foamed according to twist lay length of its associated pair, according to certain exemplary embodiments of the present invention.

A jacket 120 typically having a polymer-based composition seals the communication cable 100 from the environment and provides strength and structural support. In one exemplary embodiment, the jacket 120 has an outer diameter of about 0.205 inches and a wall thickness of about 0.016 inches. In various embodiments, the jacket 120 comprises polymeric material, polyvinyl chloride ("PVC"), polyurethane, one or more polymers, a fluoropolymer, polyethylene, neoprene, cholorosulphonated polyethylene, fluorinated ethylene propylene ("FEP"), flame retardant PVC, low temperature oil resistant PVC, polyolefin, flame retardant polyurethane, flexible PVC, or some other appropriate material known in the art, or a combination thereof, for example. In certain exemplary embodiments, the jacket 120 can comprise flame retardant and/or smoke suppressant materials.

The jacket 120 can be single layer or have multiple layers. In certain exemplary embodiments, a tube or tape (not illustrated) can be disposed between the jacket 120 and the twisted pairs 105. Such a tube or tape can be made of polymeric or dielectric material, for example. In various embodiments, the jacket 120 can be characterized as an outer jacket, an outer sheath, a casing, a circumferential cover, or a shell.

The communication cable 100 can comprise shielding or may be unshielded, as FIG. 1 illustrates. In certain exemplary embodiments, a metallic foil or other electrically conductive material can cover the twisted pairs 105 and/or the cable core 125 to provide shielding. In certain exemplary embodiments, the communication cable 100 can be shielded with a system of electrically isolated patches of shielding material, for example as described in U.S. patent application Ser. No. 12/313,914, entitled "Communication Cable Comprising Electrically Isolated Patches of Shielding Material," the entire contents of which are hereby incorporated herein by reference.

A metallic material, whether continuous or comprising electrically conductive patches, can be disposed on a substrate, such as a tape placed between the twisted pairs 105 and the jacket 120, or adhered to the jacket 120. For example, shielding, whether continuous or electrically isolated, can be disposed or sandwiched between the jacket 120 and a tube or tape that is disposed between the jacket 120 and the twisted pairs 105. In certain embodiments, the jacket 120 comprises conductive material and may be or function as a shield. In certain embodiments, the jacket 120 comprises armor, or the communication cable 100 comprises a separate, outer armor for providing mechanical protection.

In the illustrated embodiment, the cable core 125 of the communication cable 100 contains four twisted pairs 105, four being an exemplary rather than limiting number. Other exemplary embodiments may have fewer or more twisted pairs 105. The twisted pairs 105 extend along the longitudinal axis 135 of the communication cable 100 within the cable core 125.

Each twisted pair 1051, 1052, 1053, 1054 can carry data or some other form of information, for example in a range of about one to ten Giga bits per second ("Gbps") or another appropriate speed, whether faster or slower. In certain exemplary embodiments, each twisted pair 1051, 1052, 1053, 1054 supports data transmission of about two and one-half Gbps (e.g. nominally two and one-half Gbps), with the communication cable 100 supporting about ten Gbps (e.g. nominally ten Gbps). In certain exemplary embodiments, each twisted pair 1051, 1052, 1053, 1054 supports data transmission of about ten Gbps (e.g. nominally ten Gbps), with the communication cable 100 supporting about forty Gbps (e.g. nominally forty Gbps). In certain exemplary embodiments, the communication cable 100 carries about twelve and one half Gbps.

The illustrated communication cable 100 can convey four distinct channels of information simultaneously, one per twisted pair 1051, 1052, 1053, 1054. In certain exemplary embodiments, the metallic conductor diameter of each twisted pair 1051, 1052, 1053, 1054 can be in a range of about 0.0223 inches to about 0.0227 inches. The outer, insulation diameter covering each metallic conductor can be in a range of about 0.0385 inches to about 0.0395 inches, for example. As will be discussed in further detail below, the insulation covering the electrical conductors of the twisted pairs can be foamed to compensate for two or more of the twisted pairs 1051, 1052, 1053, 1054 having different twist lengths.

As will be discussed in further detail below, at least two of the twisted pairs 1051, 1052, 1053, 1054 have different twist rates (twists-per-meter or twists-per-foot). That is, at least two of the twisted pairs 1051, 1052, 1053, 1054 have different twist lengths or twist lays, which can be characterized in units of centimeters-per-twist, inches-per-twist, or inches-per-lay. In certain exemplary embodiments, each of the twisted pairs 1051, 1052, 1053, 1054 has a different twist length.

In the illustrated view, each twisted pair 1051, 1052, 1053, 1054 sweeps out a respective twist path 115 as it twists/rotates, with the twist paths 115 generally circular when viewed end-on as illustrated. (The twist paths 115 are illustrated in approximation.)

In certain exemplary embodiments, the differences between twist rates of twisted pairs 105 that are circumferentially adjacent one another (for example the twisted pair 1051 and the twisted pair 1052) are greater than the differences between twist rates of twisted pairs 105 that are diagonal from one another (for example the twisted pair 1051 and the twisted pair 1053). As a result of having similar twist rates, the twisted pairs 105 that are diagonally disposed can be more susceptible to crosstalk issues than the twisted pairs 105 that are circumferentially adjacent. The different twist lengths can help reduce crosstalk among the twisted pairs 105.

The cable core 125 can be filled with a gas such as air (as illustrated) or alternatively a gelatinous, solid, powder, moisture absorbing material, water-swellable substance, dry filling compound, or foam material, for example in interstitial spaces between the twisted pairs 105. Other elements can be added to the cable core 125, for example one or more optical fibers, additional electrical conductors, additional twisted pairs, or strength members, depending upon application goals.

In the illustrated embodiment, the communication cable 100 comprises a flexible member 150 that maintains a desired orientation of the twisted pairs 105 to provide beneficial signal performance. The illustrated embodiment of the flexible member 150 has a cross sectional geometry resembling the letter "T." Other embodiments, may be shaped like an "X," a "Y," a "J," a "K", an "L" an "I," a plus sign, or have a form of a flat strip, or comprise two or three or more fins, for example. In certain exemplary embodiments, the communication cable 100 may not include a flexible member for maintaining geometric orientation of the twisted pairs 105.

In various exemplary embodiments, the flexible member 150 can comprise polypropylene, PVC, polyethylene, FEP, ethylene chlorotrifluoroethlyene ("ECTFE"), or some other suitable polymeric or dielectric material, for example. The flexible member 150 can be filled, unfilled, foamed, un-foamed, homogeneous, or inhomogeneous and may or may not comprise additives. The flexible member 150 can comprise flame retardant and/or smoke suppressant materials. In certain exemplary embodiments, the strip 155 is crosslinked. The flexible member 150 can be extruded, pultruded, or formed in another appropriate process known in the art.

The flexible member 150 can have a substantially uniform composition, can be made of a wide range of materials, and/or can be fabricated in a single manufacturing pass. Further, the flexible member 150 can be foamed, can be a composite, and can include one or more strength members, fibers, threads, or yarns. Additionally, the flexible member 150 can be hollow to provide a cavity that may be filled with air or some other gas, gel, fluid, moisture absorbent, water-swellable substance, dry filling compound, powder, an optical fiber, a metallic conductor, shielding, or some other appropriate material or element.

In certain exemplary embodiments, the flexible member 150 can comprise electrically conductive patches that are electrically isolated from one another to provide one or more shields. Such patches can adhere to a surface of the flexible member 150, for example.

Figure 2:
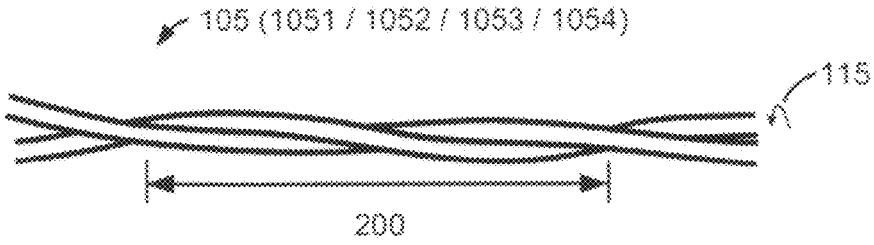
FIG. 2 is an illustration of an exemplary twisted pair of a communication cable in accordance with certain embodiments of the present invention.

Turning now to FIG. 2, this figure illustrates a twisted pair 105 (1051, 1052, 1053, 1054) of the communication cable 100 according to certain exemplary embodiments of the present invention. The twisted illustrated twisted pair 105 has a twist length 200 (which may also be characterized as twist lay). For example, if the insulated electrical conductors 201 and 202 of the illustrated pair 105 are twisted together so as to revolve around one another two times-per-inch, the twist rate would be two twists-per-inch, and the twist length or lay length would be one-half inch. In certain exemplary embodiments, each of the twisted pairs 1051, 1052, 1053, 1054 of the communication cable 100 has a different twist length 200. In certain exemplary embodiments, the twist lengths 200 of the twisted pairs 105 can be in a range of about 0.250 to 0.800 inches, 0.280 to 0.420 inches, or 0.350 to 0.475 inches, for example.

In various exemplary embodiments, the twisted pairs 105 can have a common twist direction that is clockwise or counterclockwise. In certain embodiments, at least one of the twisted pairs 1051, 1052, 1053, 1054 can be twisted in a clockwise direction, while other ones are twisted counterclockwise. Accordingly, the twisted pairs 105 may have a "left hand lay" or a "right hand lay" or a combination thereof.

Figure 3:
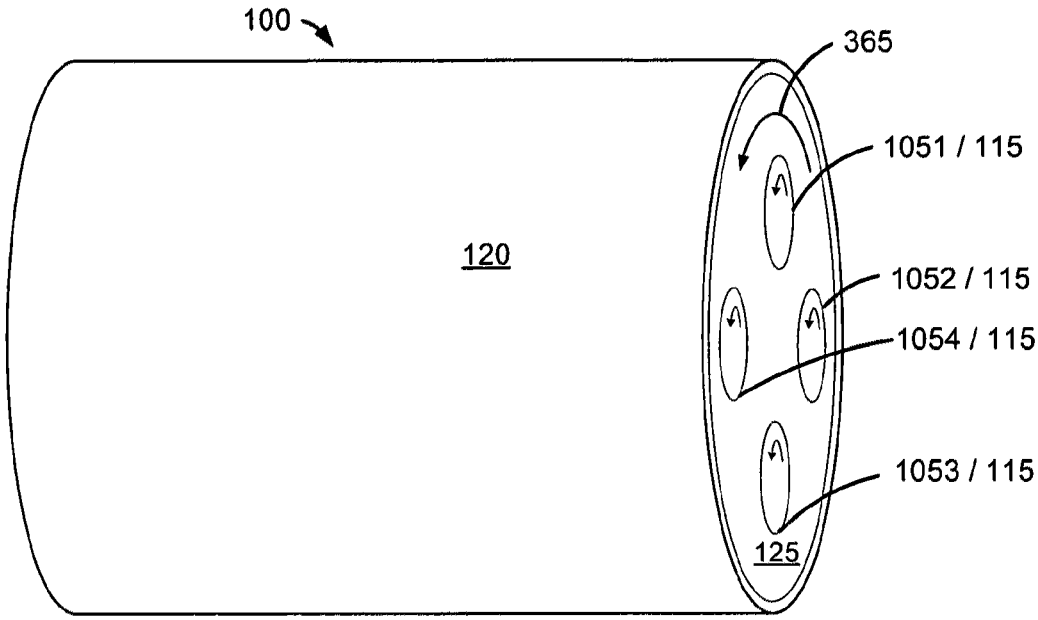
FIG. 3 is an illustration depicting exemplary twists of a communication cable in accordance with certain embodiments of the present invention.

Turning now to FIG. 3, this figure illustrates twists of the communication cable 100 according to certain exemplary embodiments of the present invention. In the illustrated embodiment of FIG. 3, the core 125 has a twist 365 in a direction that is common to the pair twist. Thus, the core 125 and the twisted pairs 1051, 1052, 1053, 1054 can each have left hand lay or twist in counterclockwise direction as illustrated. Alternatively, the core 125 and the twisted pairs 1051, 1052, 1053, 1054 can each have right hand lay or twist in clockwise direction. Accordingly, the four twisted pairs 1051, 1052, 1053, 1054 can be collectively twisted about a longitudinal axis 135 of the communication cable 100 in a common direction.

Figure 4:
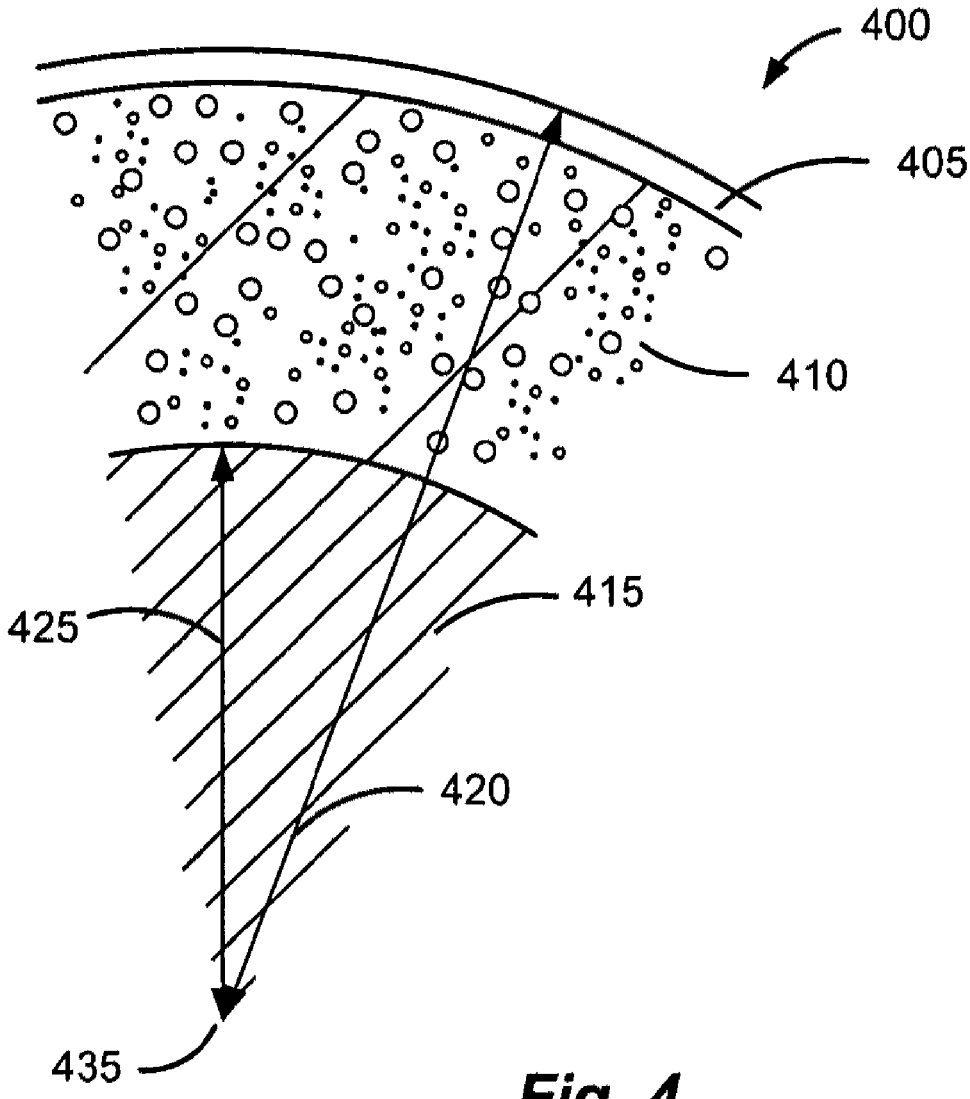
FIG. 4 is an illustration depicting exemplary insulation covering an electrical conductor of a twisted pair in accordance with certain embodiments of the present invention.
Figure 6A:
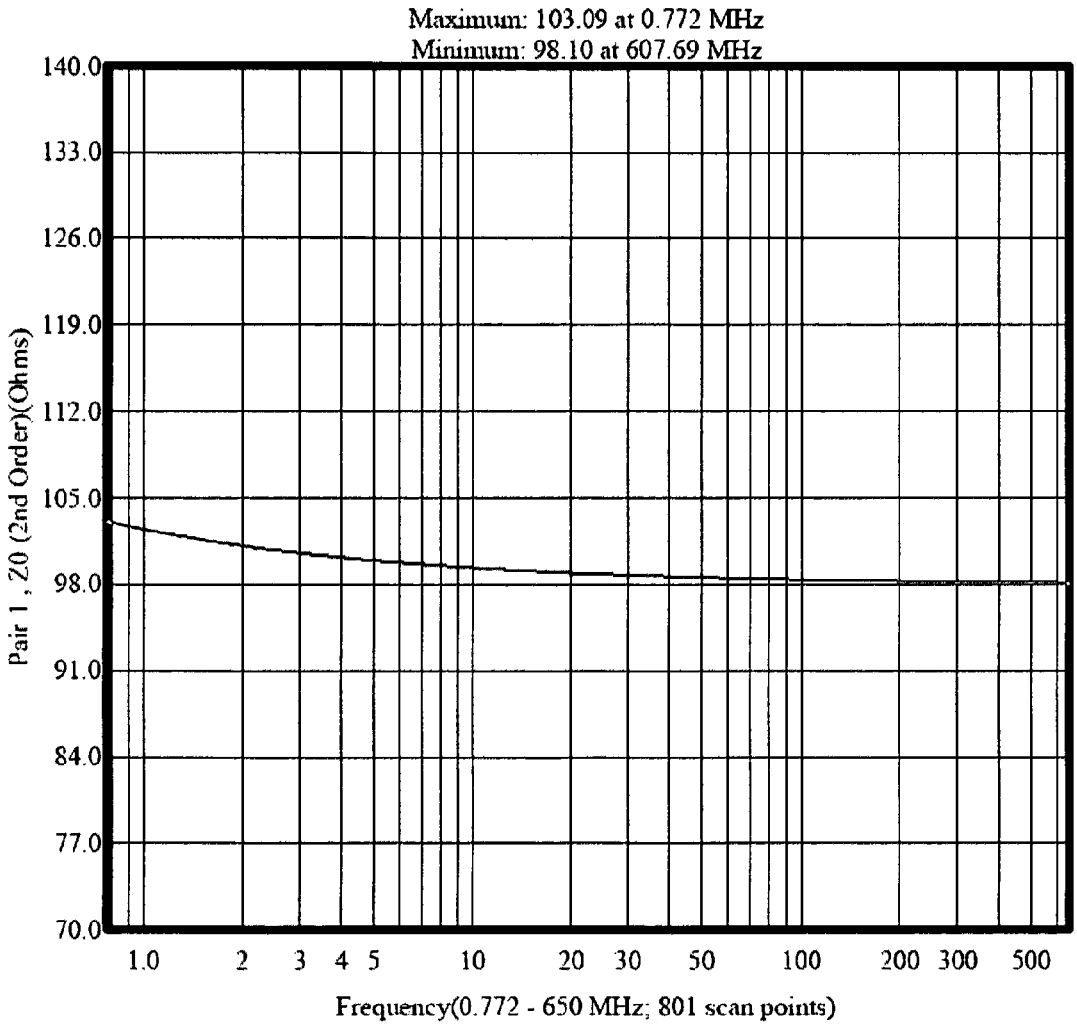
FIGS. 6A, 6B, 6C, and 6D, collectively
Figure 6B:
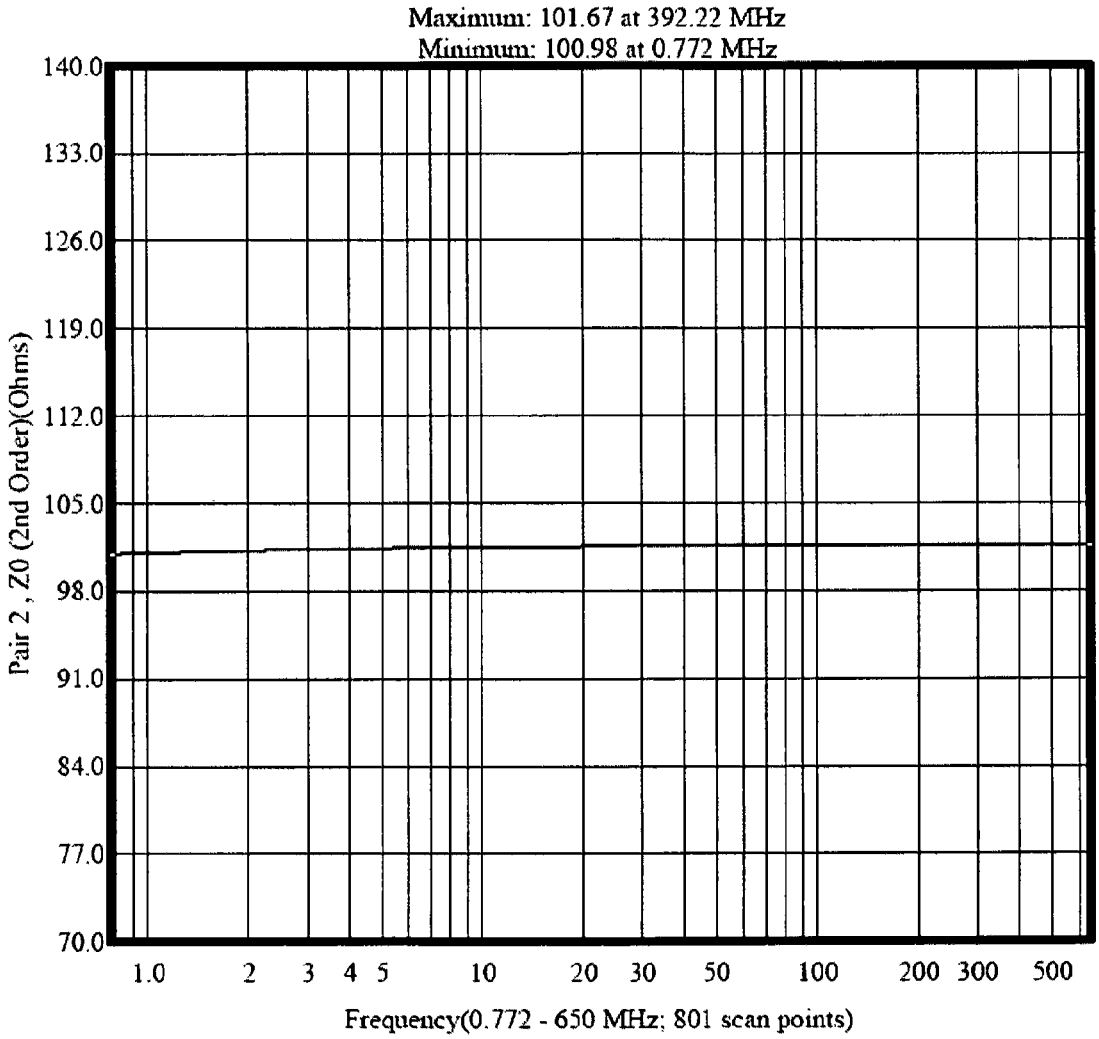
Figure 6C:
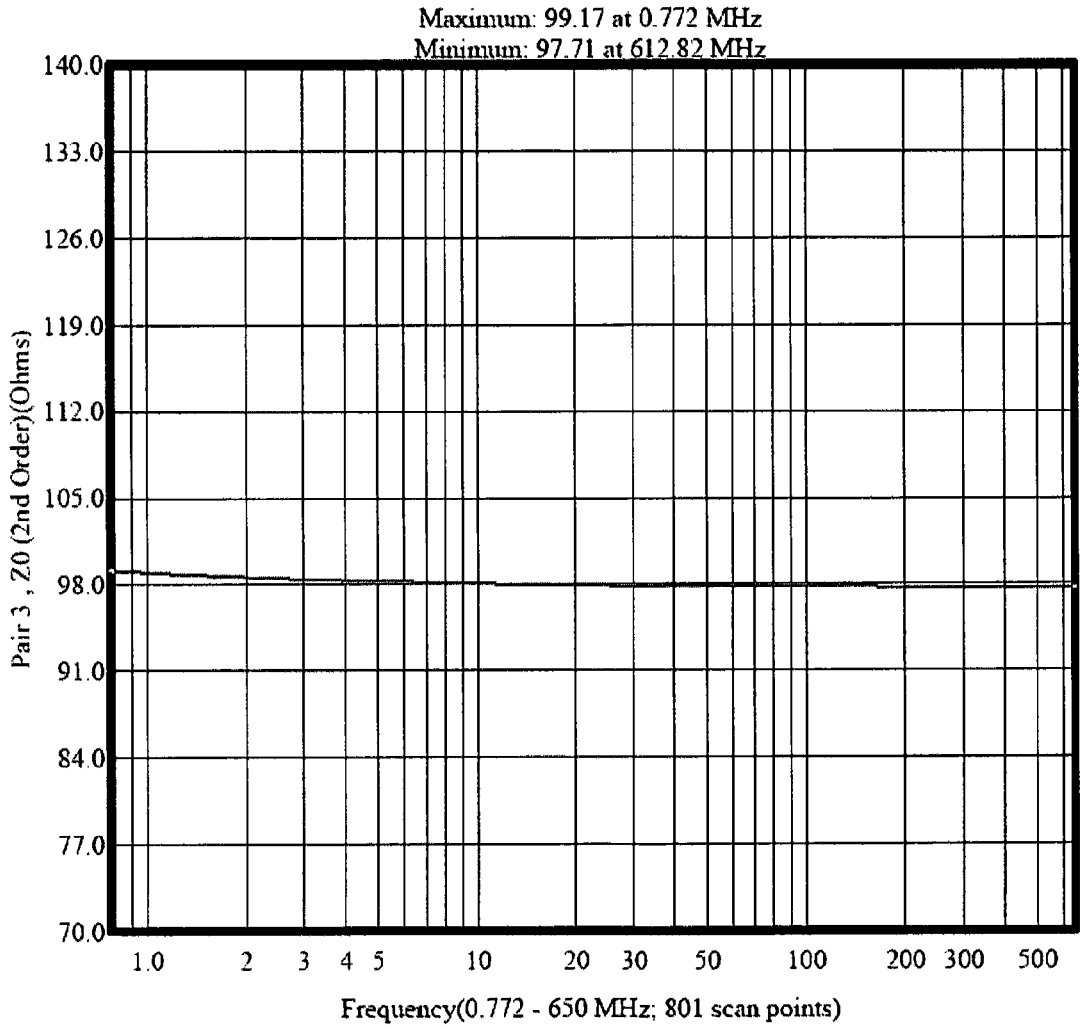
Figure 6D:
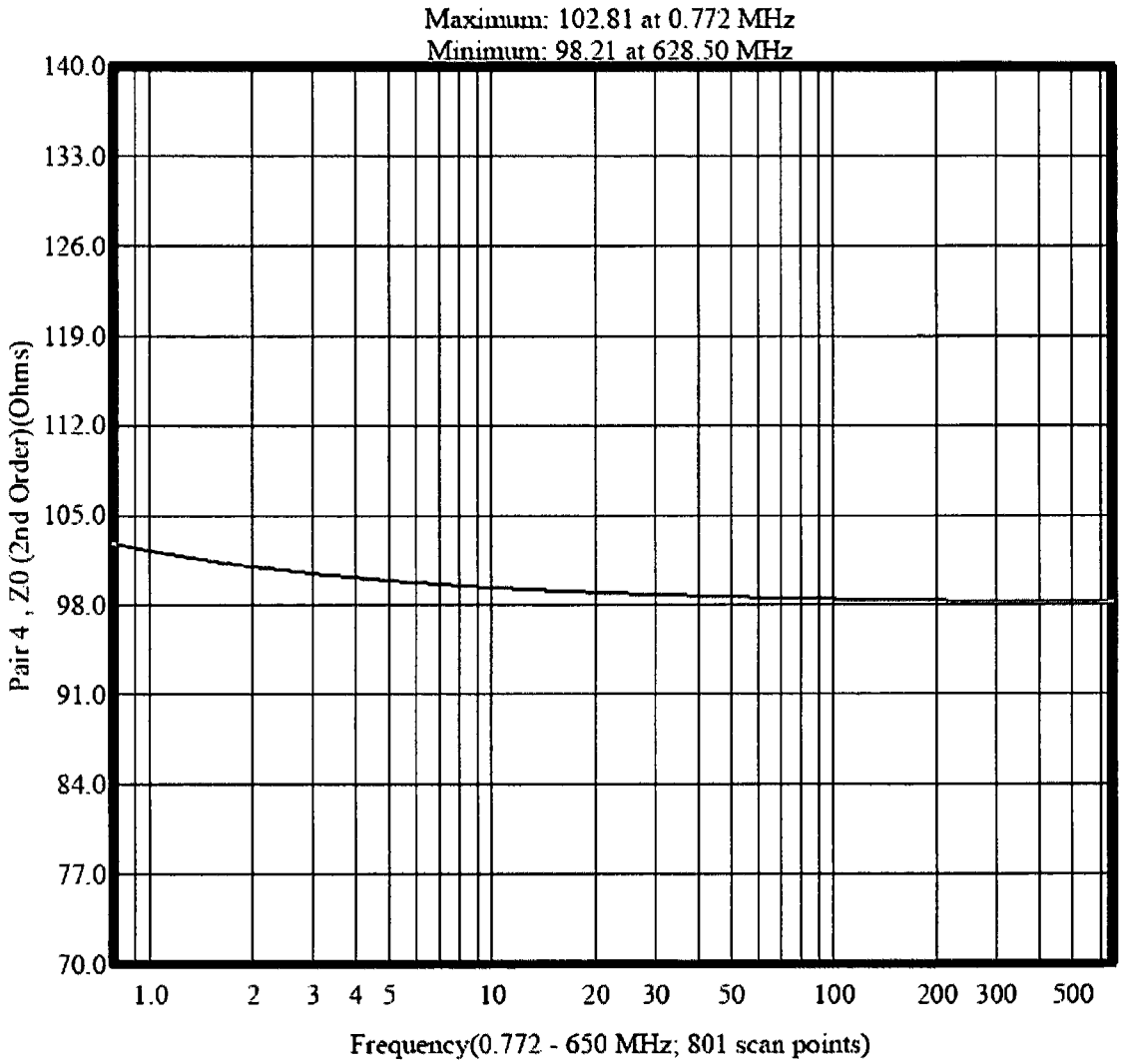
Figure 7A:
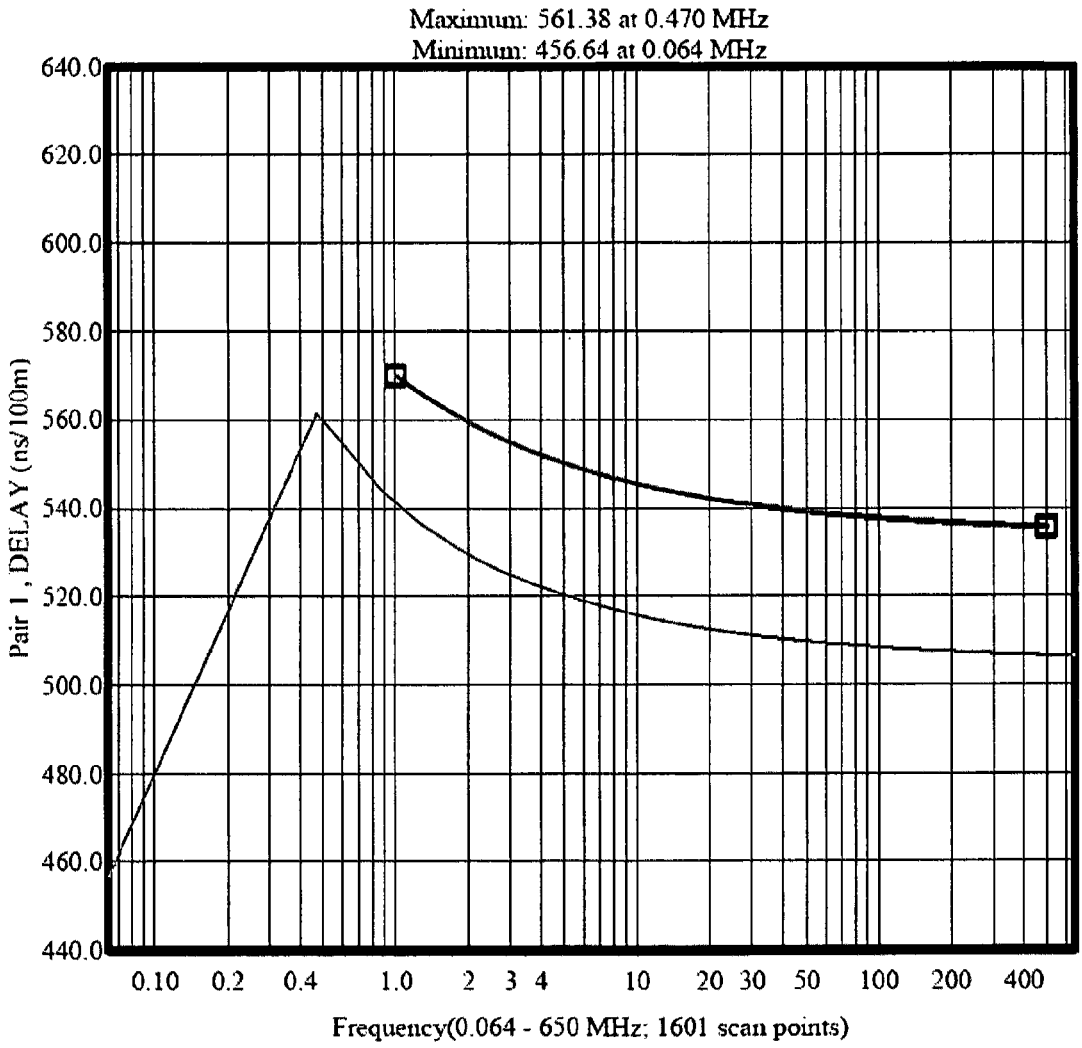
FIGS. 7A, 7B, 7C, and 7D, collectively
Figure 7B:
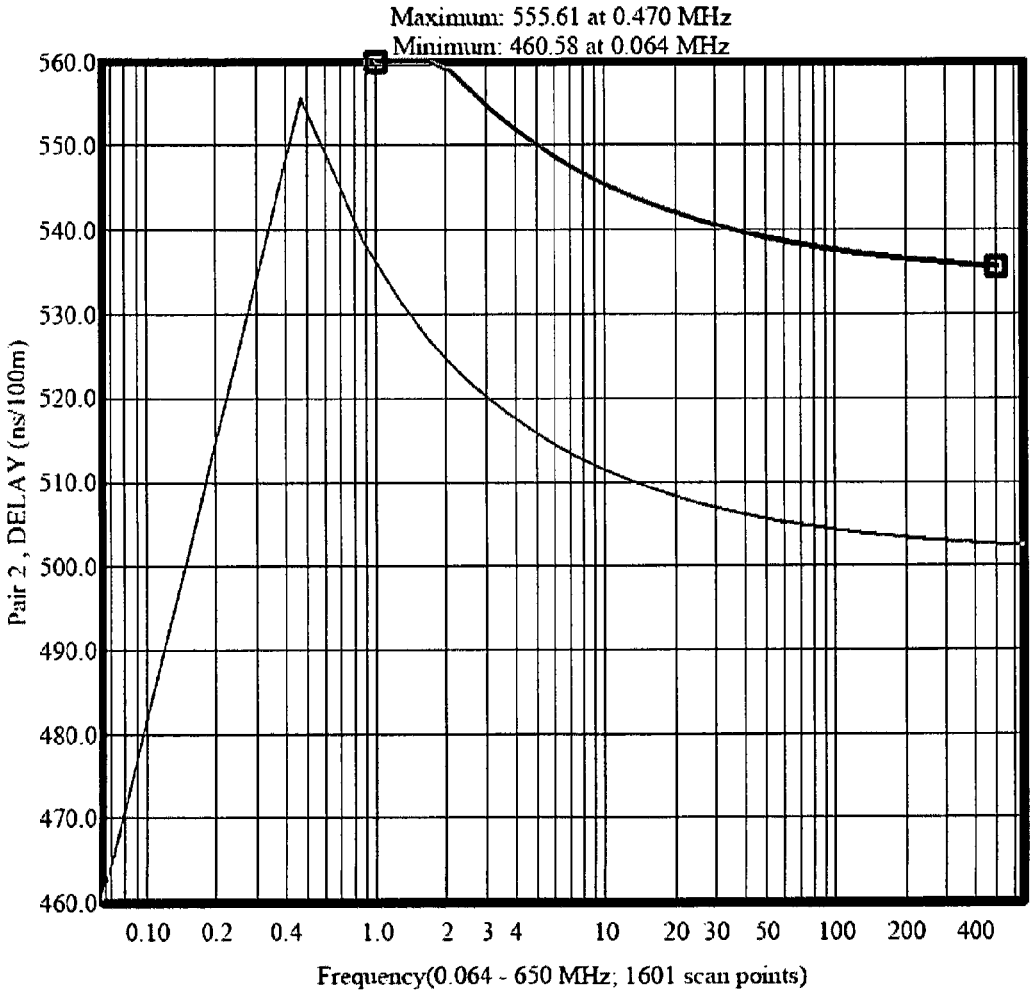
Figure 7C:
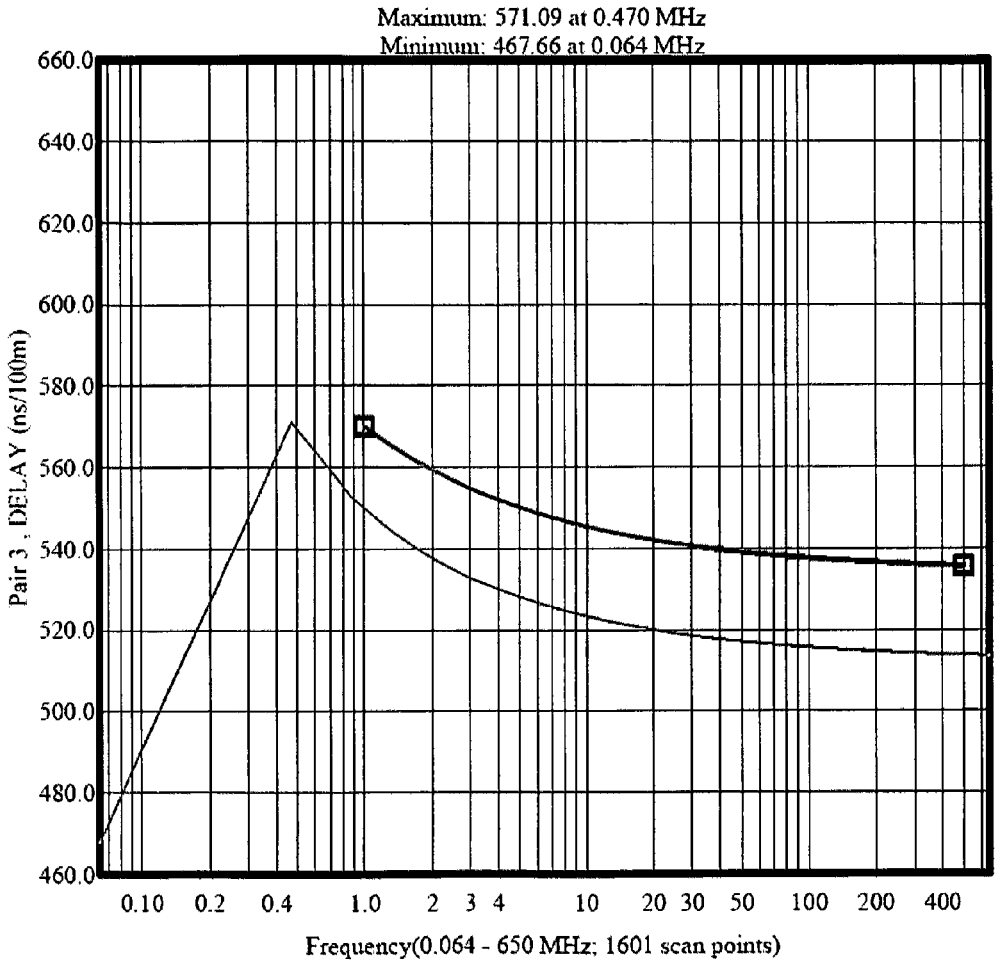
Figure 7D:
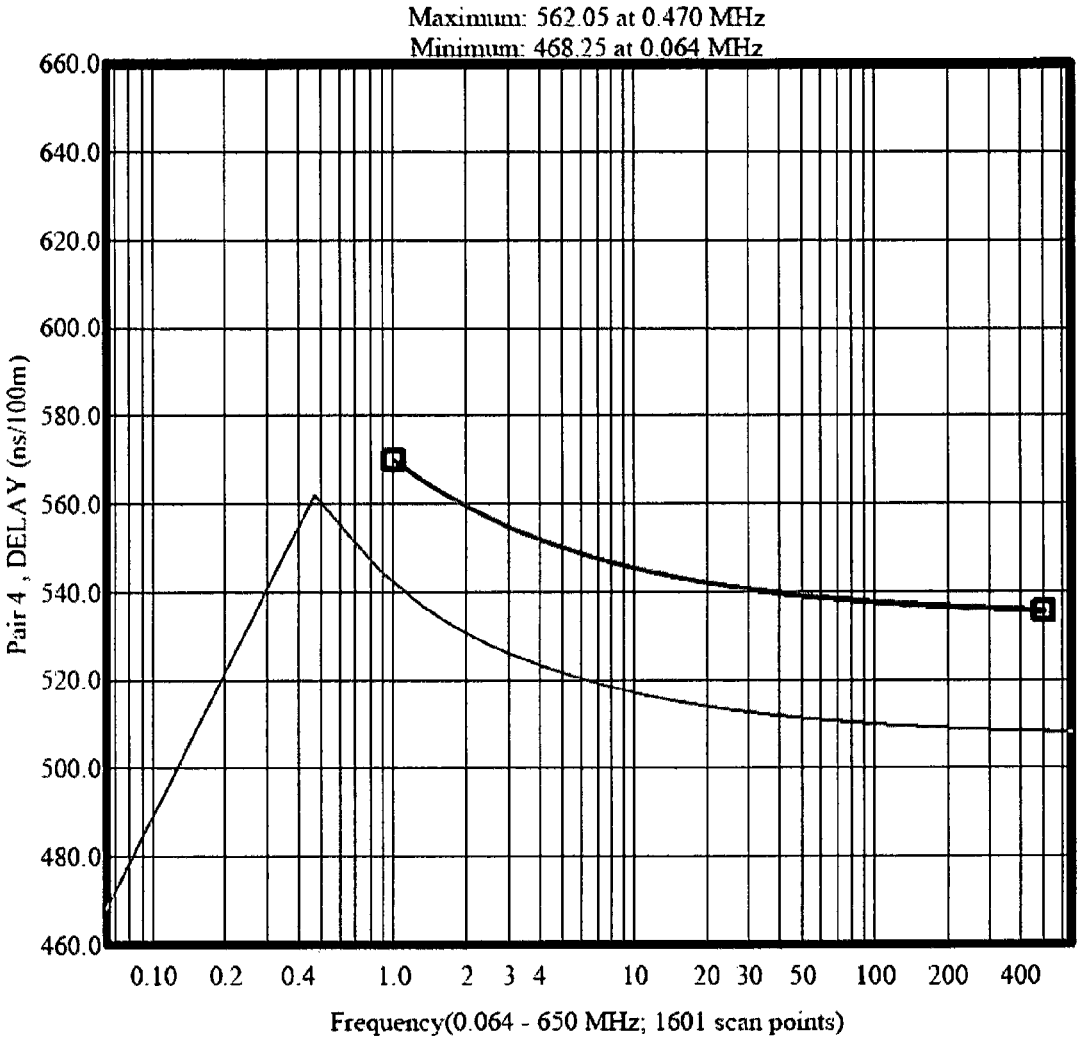
Figure 8A:
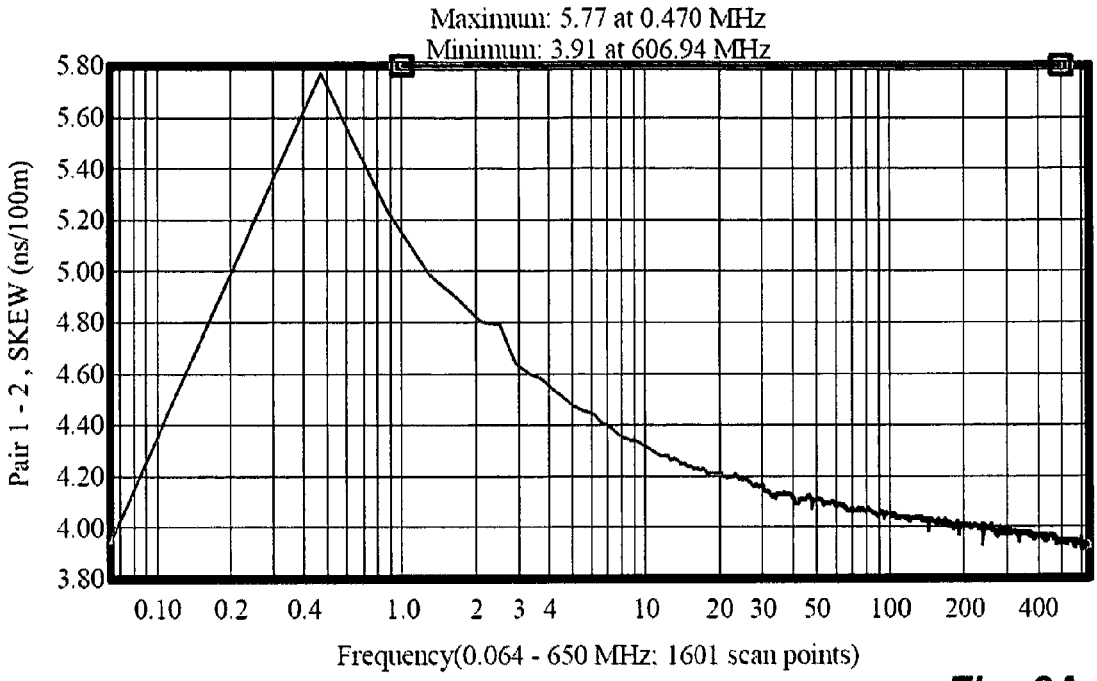
FIGS. 8A, 8B, 8C, 8D, 8E, and 8F, collectively
Figure 8B:
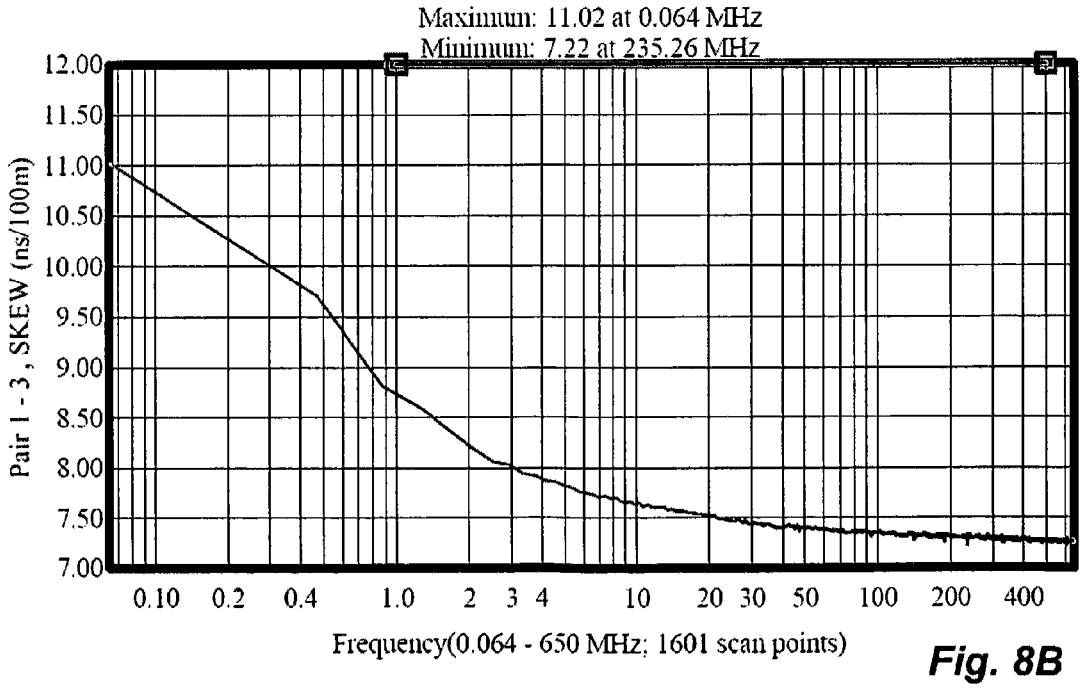
Figure 8C:
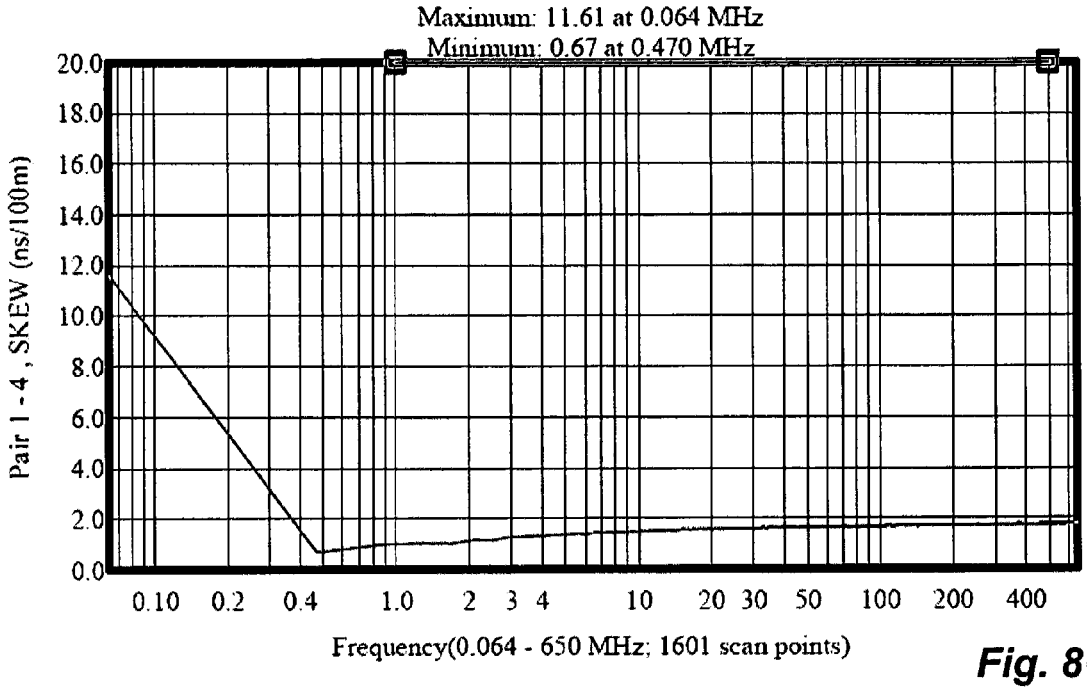
Figure 8D:
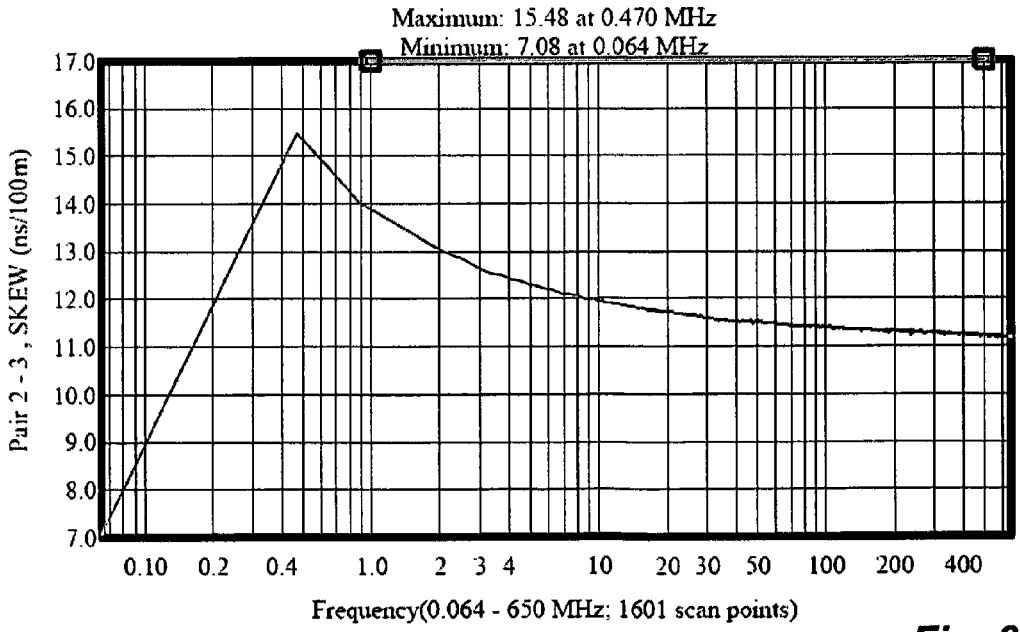
Figure 8E:
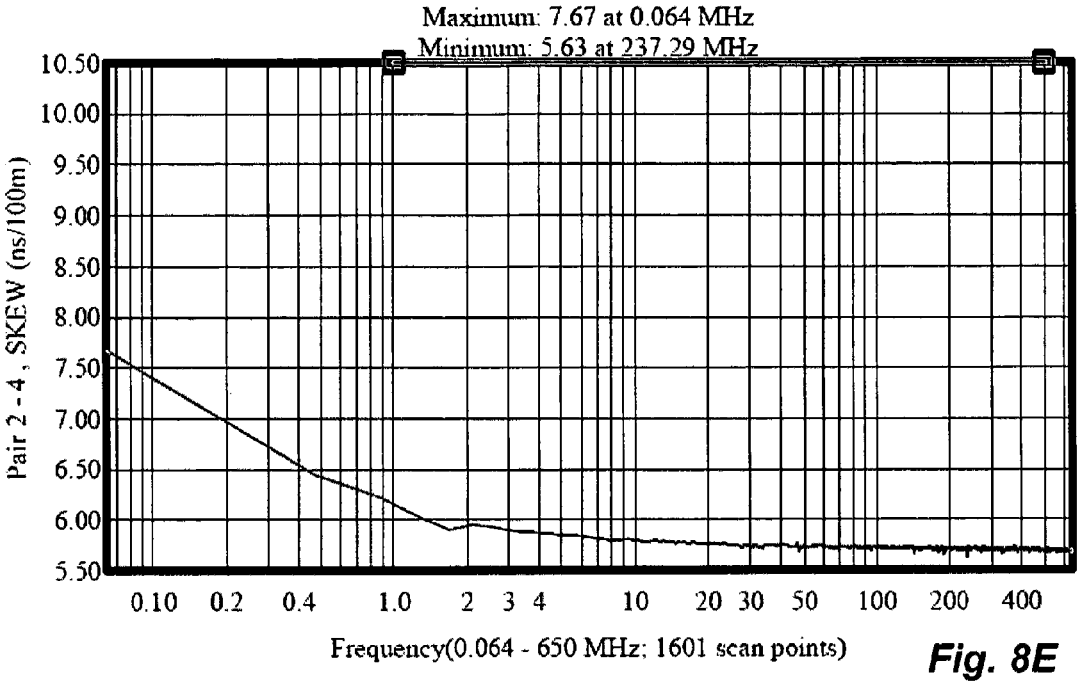
Figure 8F:
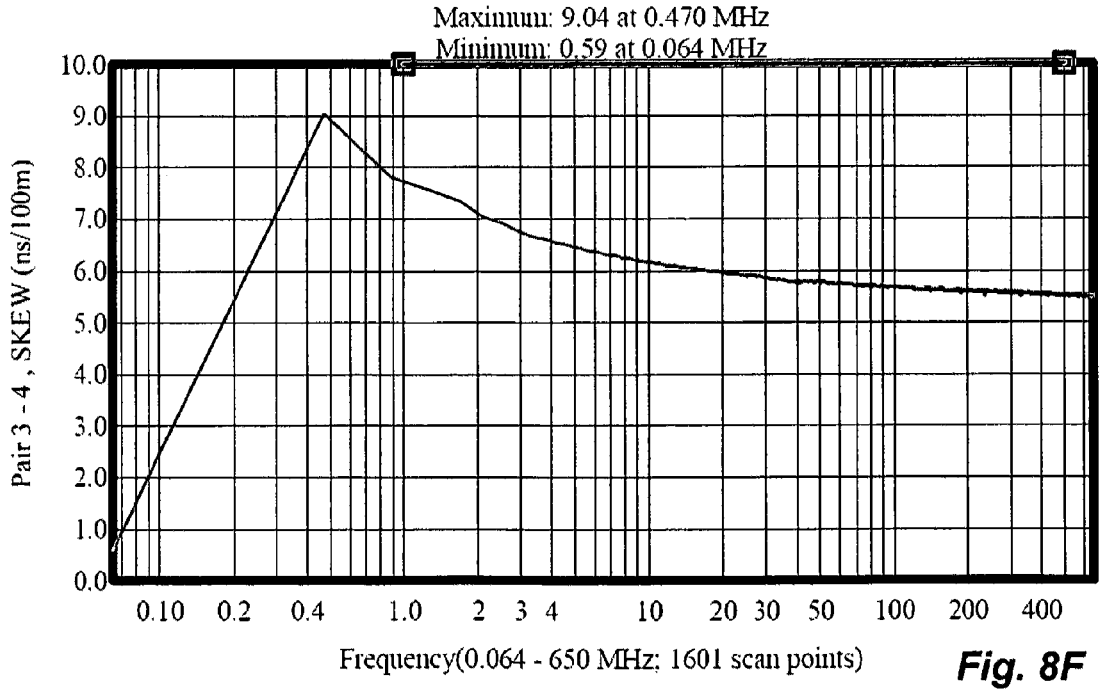
Figure 10A:
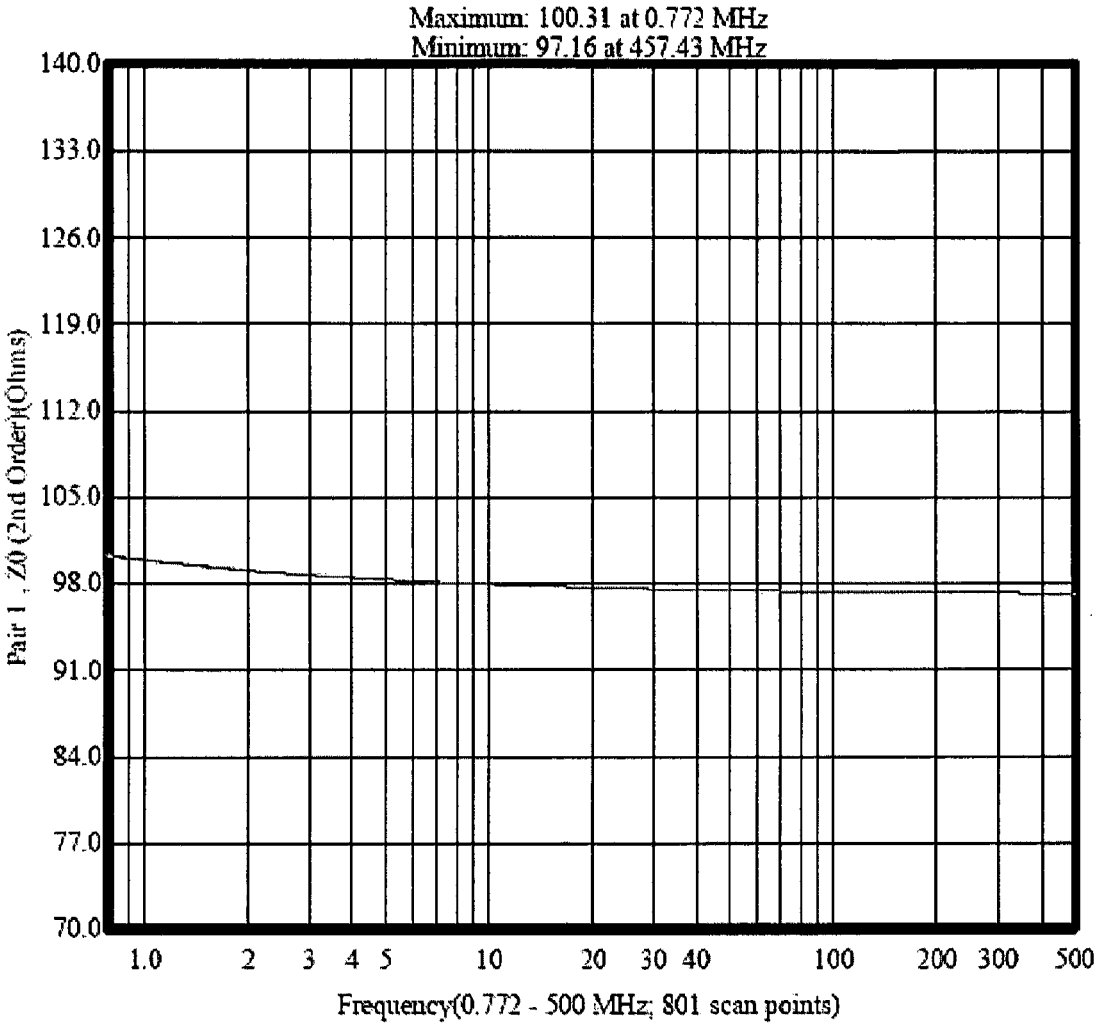
FIGS. 10A, 10B, 10C, and 10D, collectively
Figure 10B:
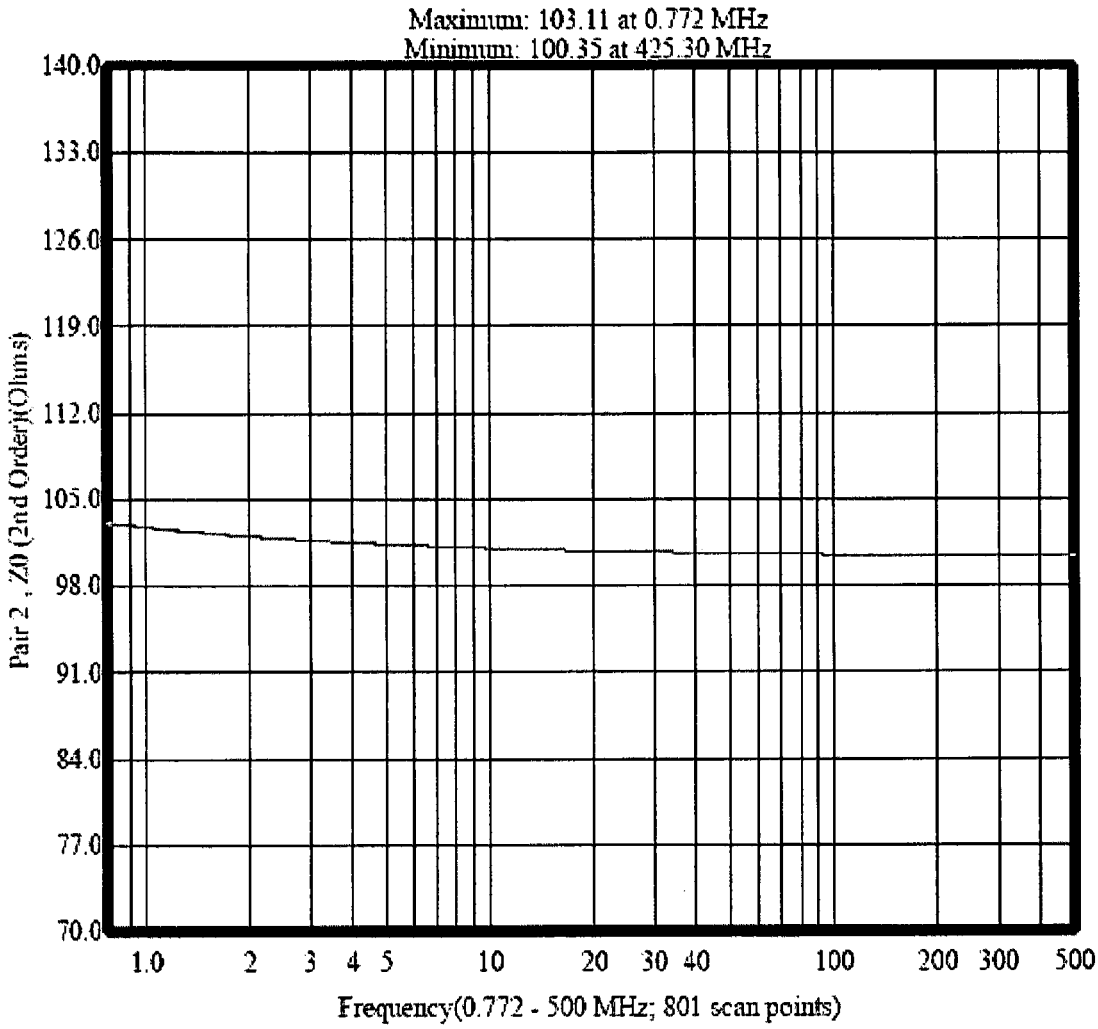
Figure 10C:
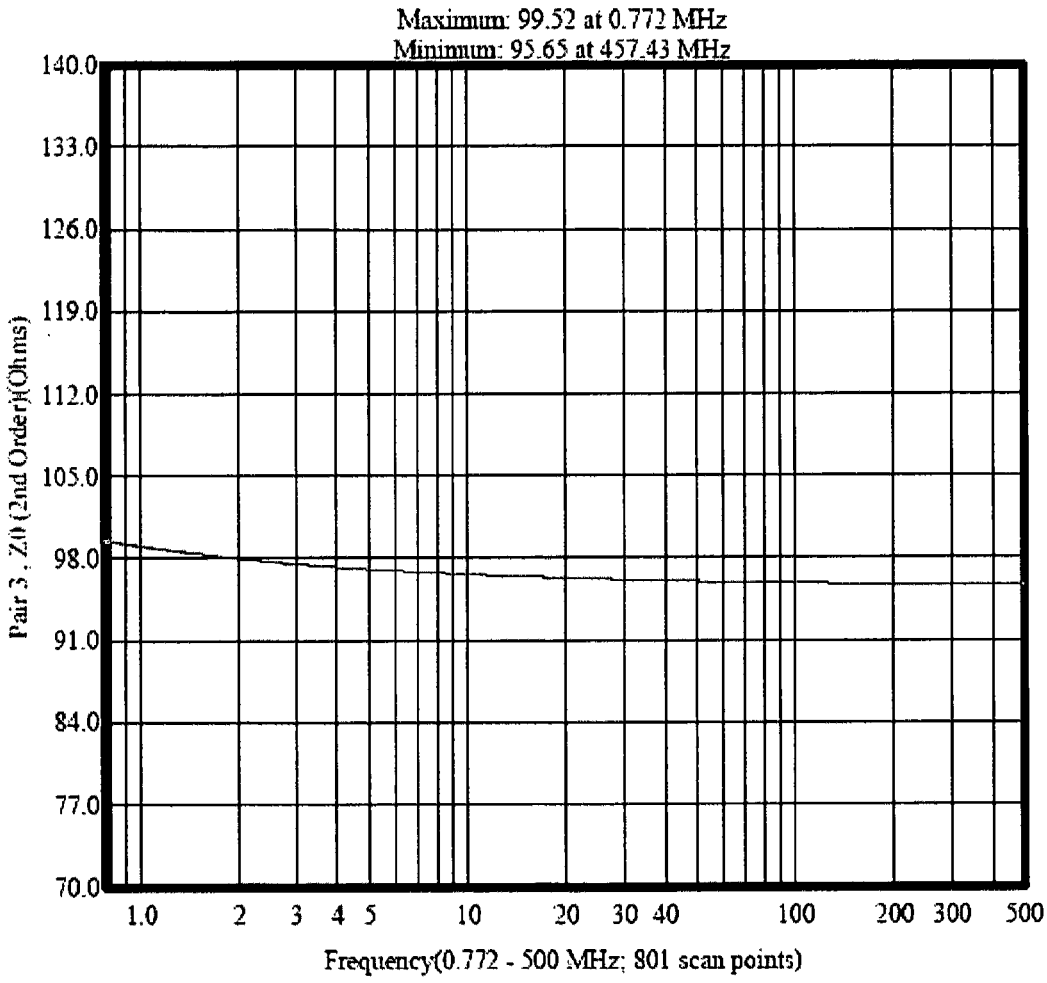
Figure 10D:
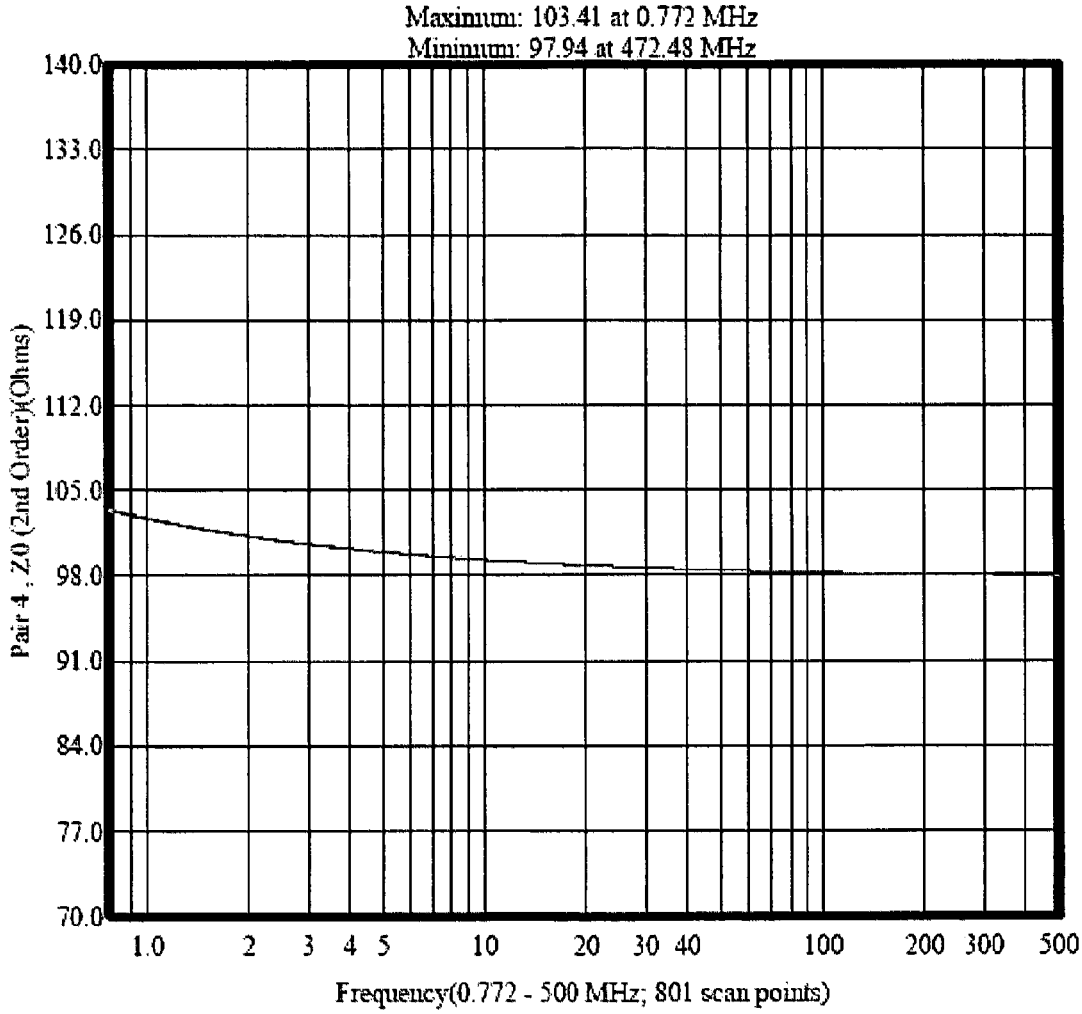
Figure 11A:
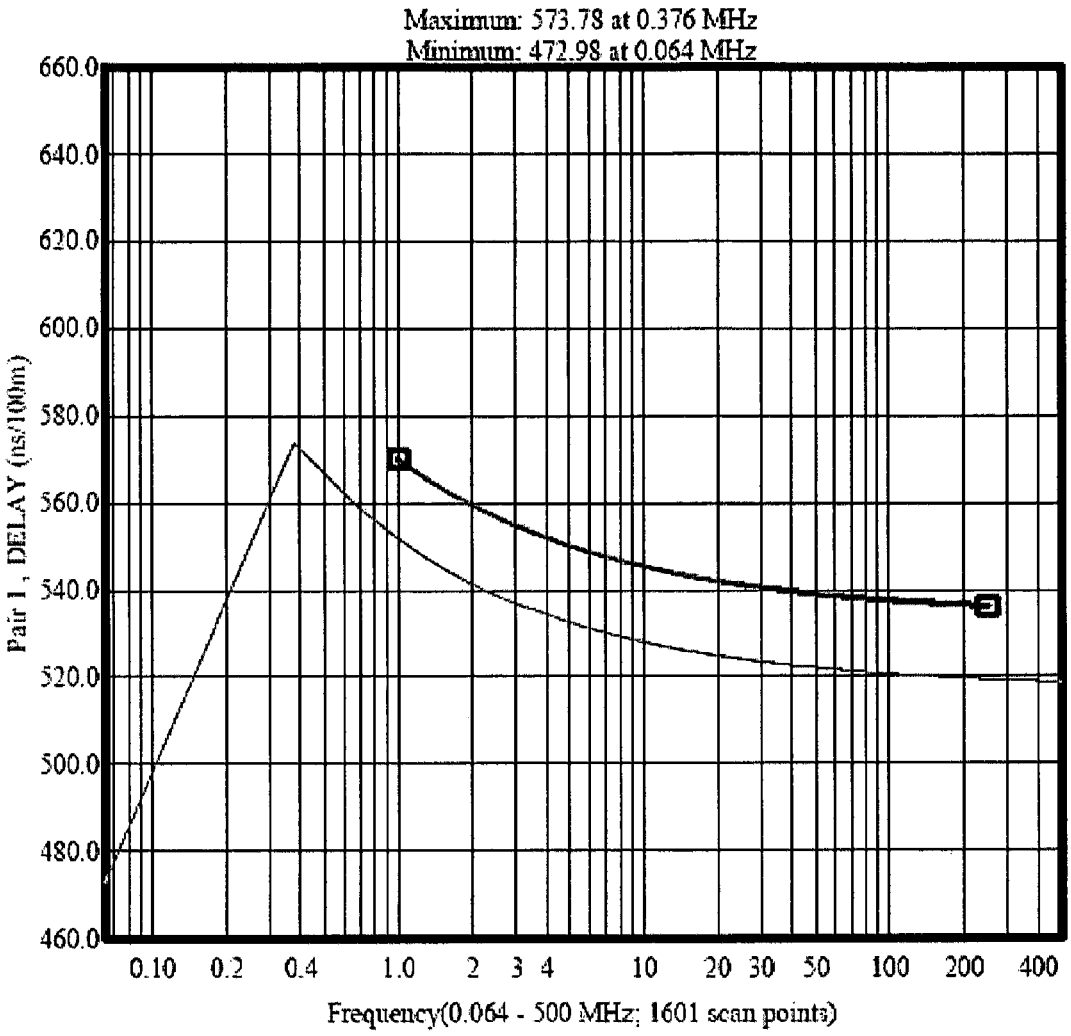
FIGS. 11A, 11B, 11C, and 11D, collectively
Figure 11B:
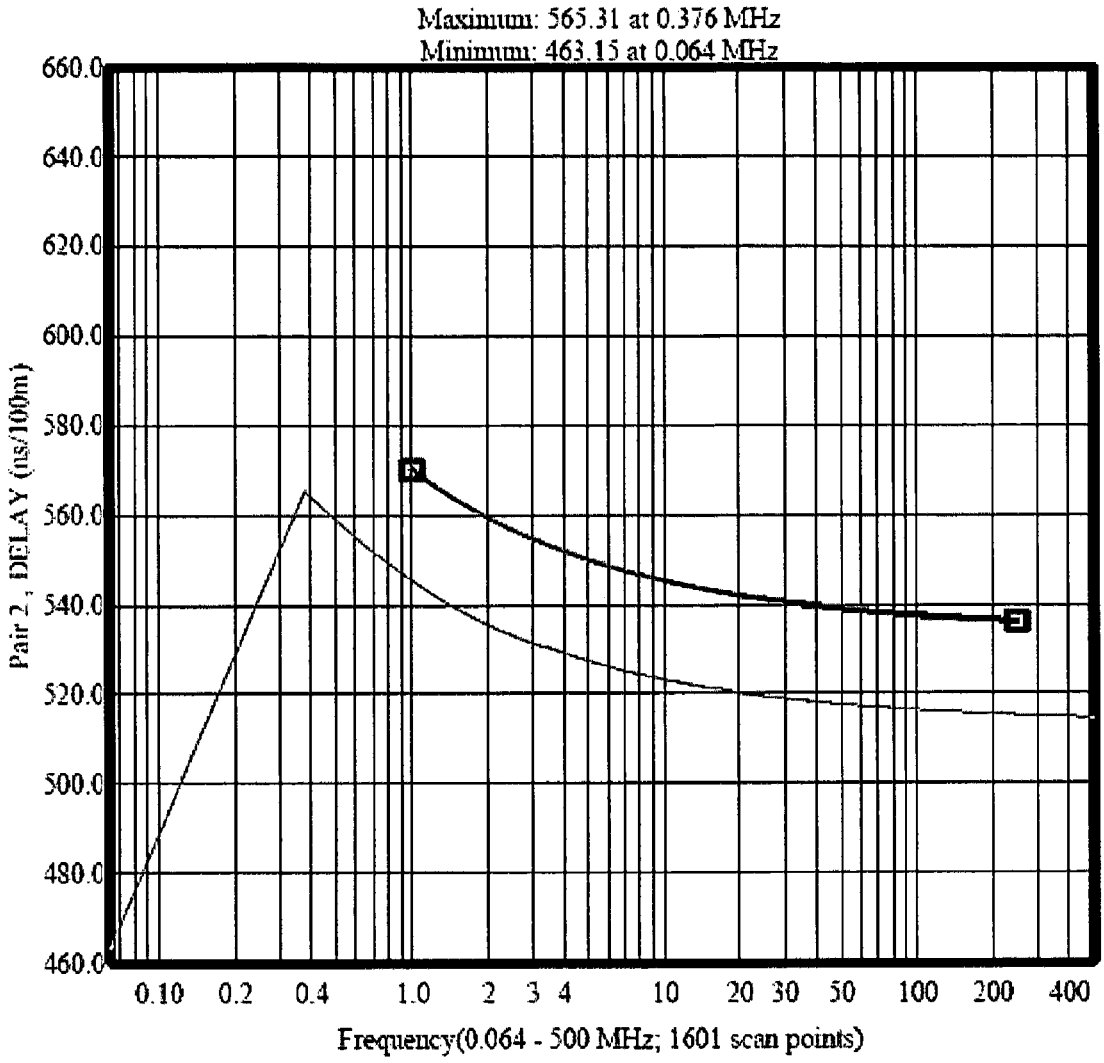
Figure 11C:
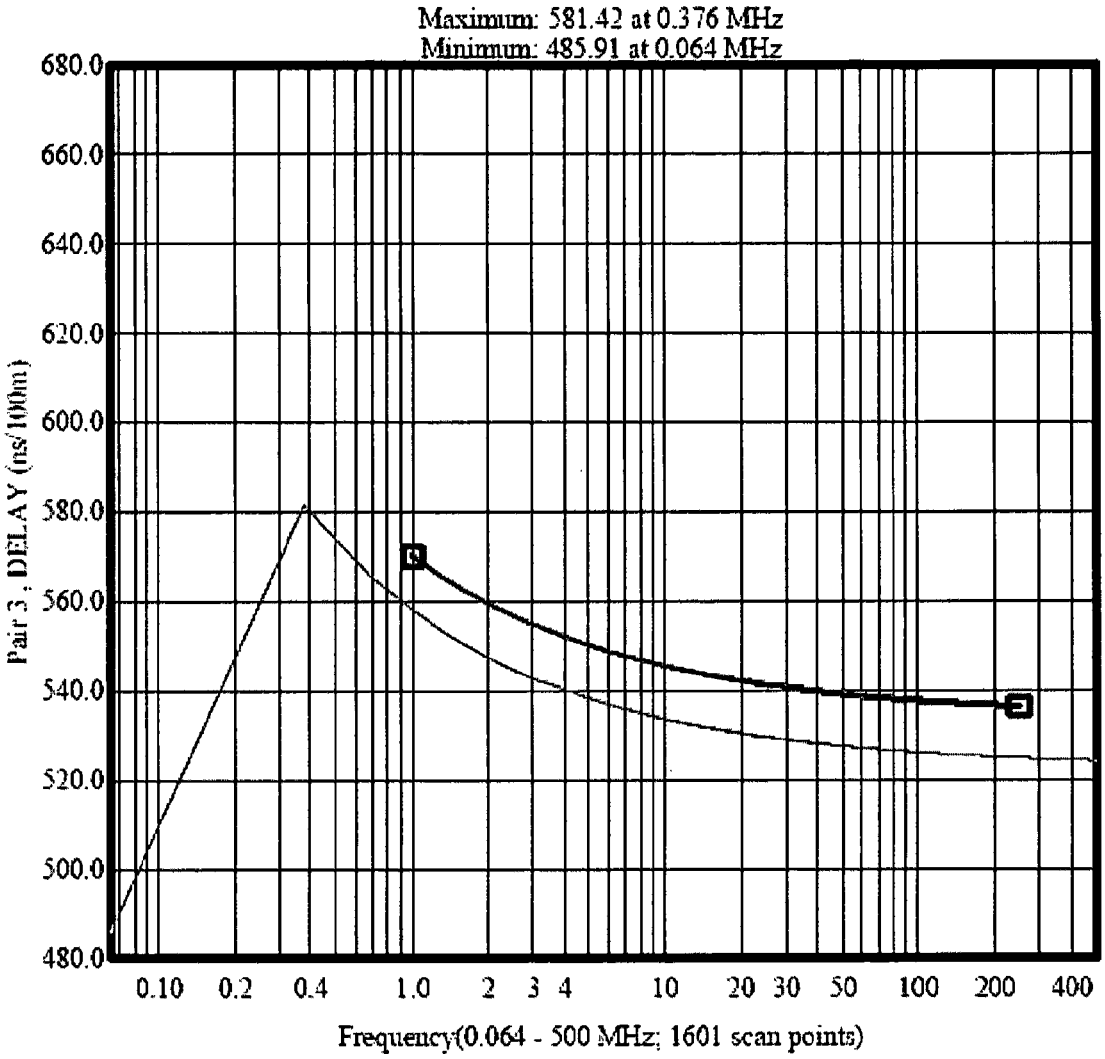
Figure 11D:
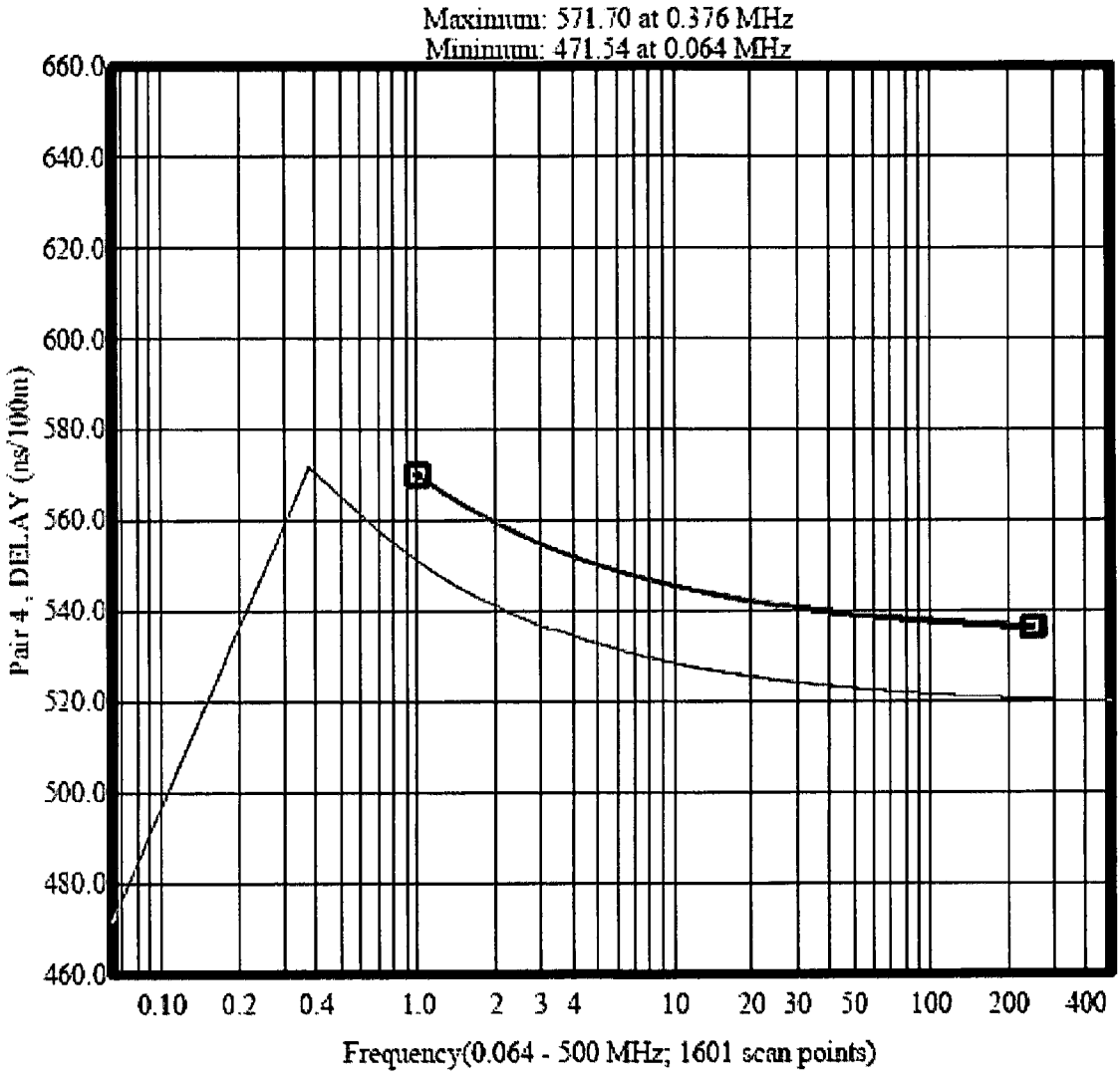
Figure 12A:
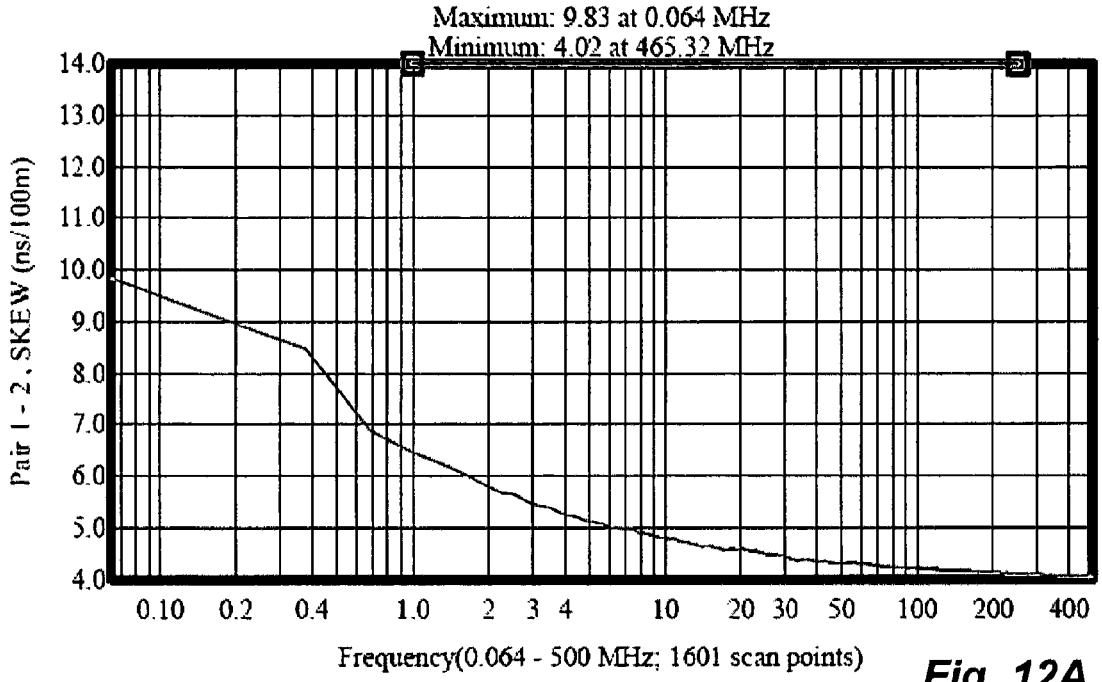
FIGS. 12A, 12B, 12C, 12D, 12E, and 12F, collectively
Figure 12B:
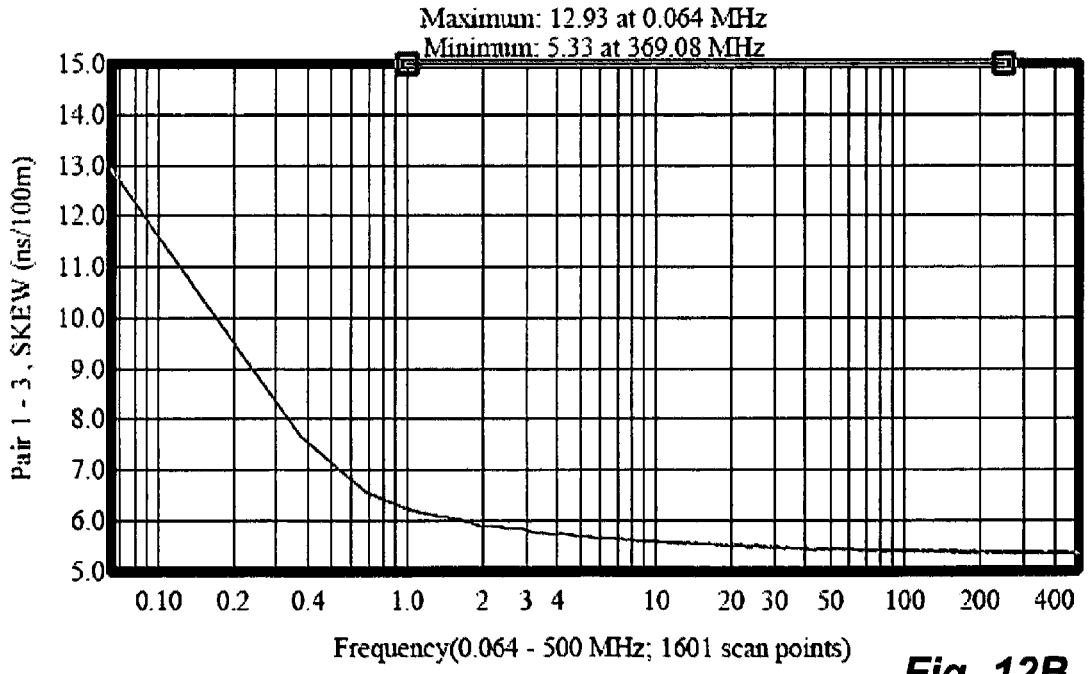
Figure 12C:
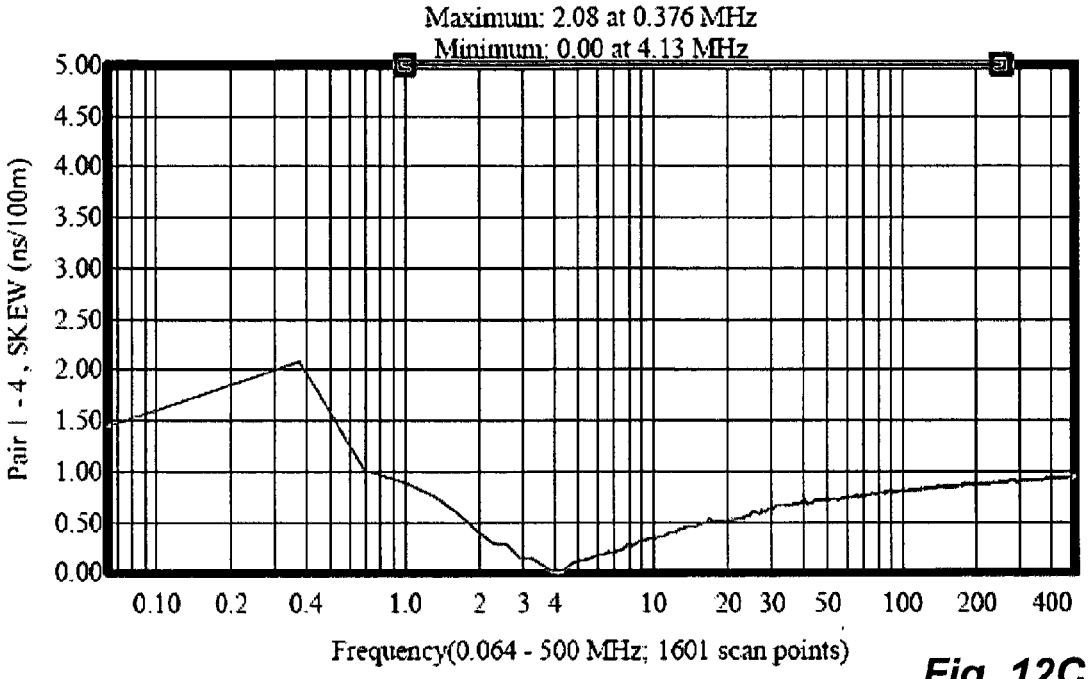
Figure 12D:
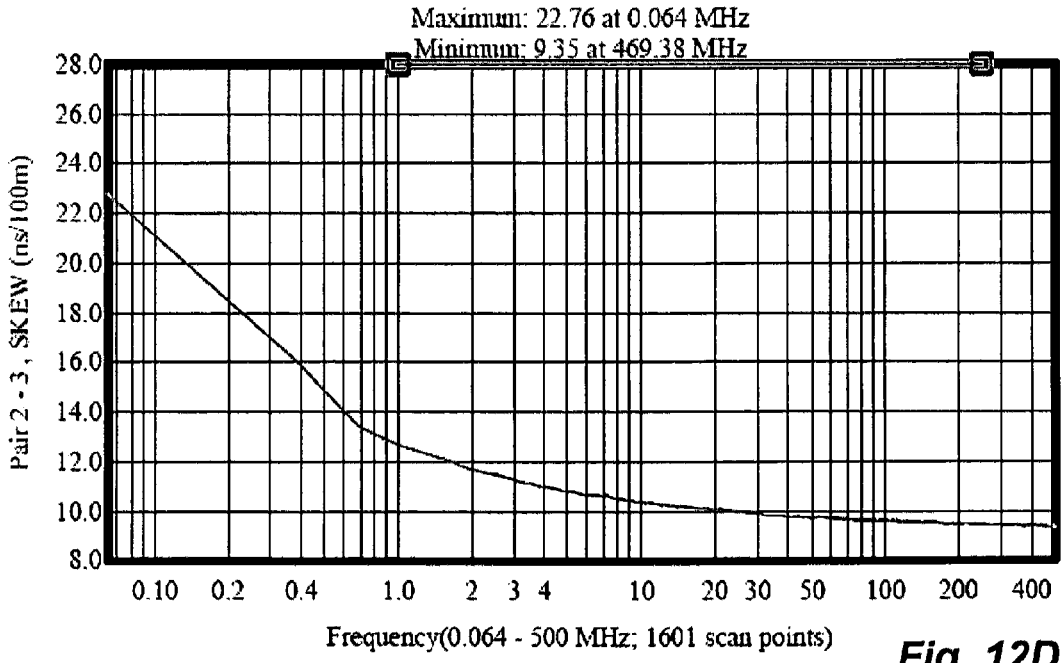
Figure 12E:
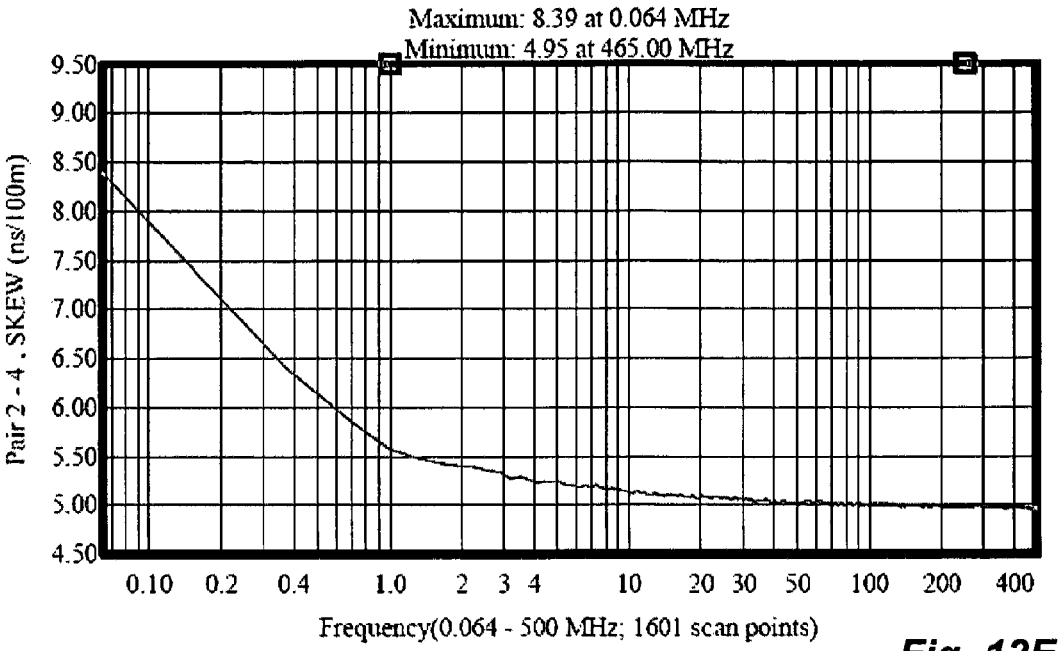
Figure 12F:
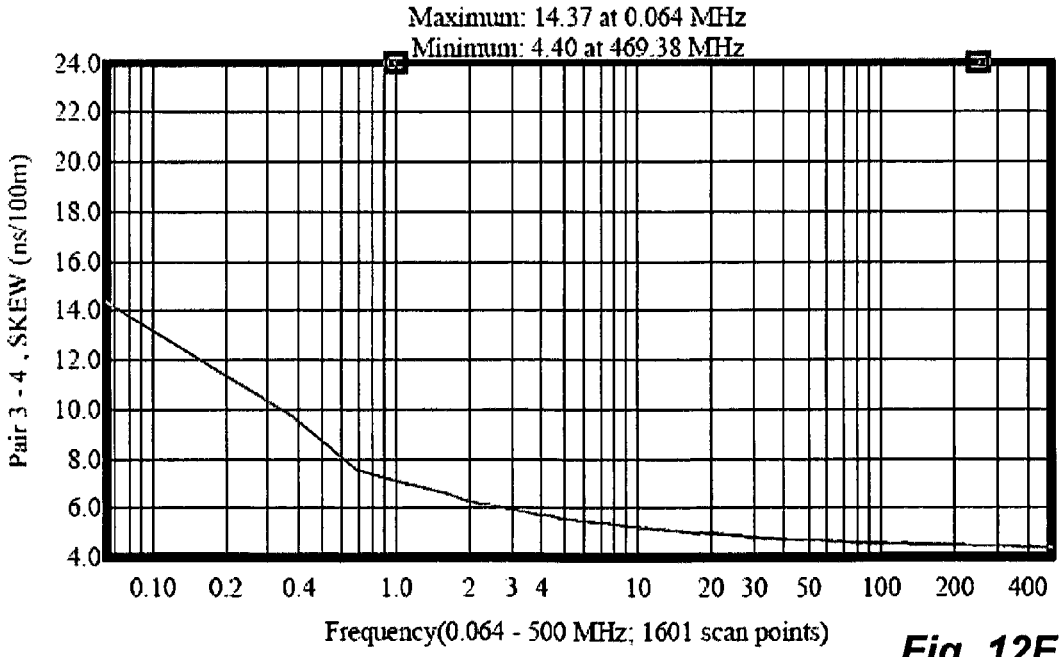

Turning now to FIG. 4, this figure illustrates insulation covering an electrical conductor 415 of a twisted pair 105 (1051, 1052, 1053, 1054) according to in certain exemplary embodiments of the present invention. The insulated electrical conductor 400 comprises a foamed insulation 410 circumferentially covering the electrical conductor 415. In the illustrated embodiment, the foamed insulation 410 comprises a skin 405, that is substantially free of foaming, circumferentially covering a foamed region. In certain other embodiments, the foaming can extend through the insulation 410, without the illustrated skin 405.

The foamed insulation 410 can be foamed with nitrogen or air, for example. In certain exemplary embodiments, the foaming levels can be in a range of 0 to 40 percent or in a range of 0 to 30 percent. Foaming can be implemented by chemical or physical (e.g. gas injection) foaming, for example. Foaming can be achieved via extruding a blend of HDPE containing a pre-compounded, commercially available chemical blowing agent with straight HDPE. Alternatively, a foam/skin insulation can be formed by extruding HDPE containing a chemical blowing agent and simultaneously extruding a covering layer of HDPE over the foam to form the skin 405.

The level of foaming typically increases with decreasing twist length 200. That is, the electrical conductors 415 of the twisted pairs 105 having relatively long twist lengths 200 have a lower level of insulation foaming than the twisted pairs 105 having relatively short twist length 200. In an exemplary embodiment, each twisted pair 1051, 1052, 1053, 1054 is twisted to a different twist length 200 and has a corresponding, distinct level of insulation foaming. Accordingly, the respective foaming levels of the insulated electrical conductors 400 in each twisted pair 1051, 1052, 1053, 1054 can be selected to balance electrical properties among the twisted pairs 105. Accordingly, the selected, distinct foaming levels can impart the twisted pairs 105 with like electrical properties. For example, the twisted pairs 105 can have desirable skew, attenuation, propagation speed, and/or characteristic impedance as a result of matching or tailoring the foaming levels to twist length 200.

In certain exemplary embodiments, the electrical conductors 415 of the communication cable 100 can have consistent or common diameters (twice the illustrated radius 425 that extends from the center axis 435 radially outward), for example being manufactured to a common specification. Alternatively, in certain exemplary embodiments, the electrical conductors 415 of different twisted pairs 105 can have different diameters. In certain exemplary embodiments, the electrical conductors 415 can be 22, 23, or 24 AWG (American Wire Gauge). In certain exemplary embodiments, the electrical conductors 415 can have a diameter in a range of about 0.0201 to 0.0253 inches, for example.

In certain exemplary embodiments, the insulated electrical conductors 400 of each twisted pair 1051, 1052, 1053, 1054 within the communication cable 100 can have an outer diameter (twice the illustrated radius 420) that is consistent or common. Alternatively, in certain exemplary embodiments, the insulated electrical conductors 400 of the communication cable 100 can have different thicknesses of insulation. In certain exemplary embodiments, the thickness of the foamed insulation 415 can be in a range of about 0.007 to 0.015 inches, for example.

In certain exemplary embodiments, the foamed insulations 410 respectively covering the electrical conductors 415 of the twisted pairs 105 can have a substantially common composition, for example being made from a common base polymer such as HDPE. In various exemplary embodiments, the foamed insulations 410 can comprise FEP, PVC, or a polyolefin such as PE, PP, or a copolymer.

FIGS. 5, 6, 7, and 8 provide construction details and laboratory testing data for a communication cable comprising electrical insulation foamed to match pair twist according to certain exemplary embodiments of the present invention. The communication cable of FIGS. 5, 6, 7, and 8 is "UTP" rated and is intended for indoor applications. That cable comprises a flexible member for maintaining pair orientation and a shield comprising electrically isolated patches of conductive shielding material, as discussed above with reference to FIG. 1.

FIG. 5 illustrates a table containing construction details for the communication cable. Those skilled in the art having benefit of this disclosure will appreciate that the indicated levels of twist and foaming and other design features are exemplary and not limiting and among others supported by exemplary embodiments of the present invention. FIG. 6 illustrates plots of characteristic impedance data obtained via laboratory testing of the communication cable. FIG. 7 illustrates plots of propagation delay data obtained via laboratory testing of the communication cable. FIG. 8 illustrates plots of propagation delay skew obtained via laboratory testing of the communication cable.

FIGS. 9, 10, 11, and 12 provide construction details and laboratory testing data for another communication cable comprising electrical insulation foamed to match pair twist according to certain exemplary embodiments of the present invention. The communication cable of FIGS. 9, 10, 11, and 12 is classified as "Category 6" and intended for indoor/outdoor applications. That cable comprises an electrically continuous shield and has a core filled with Unilite Flooding PE compound.

FIG. 10 illustrates a table containing construction details for the communication cable. Those skilled in the art having benefit of this disclosure will appreciate that the indicated levels of twist and foaming and other design features are exemplary and not limiting and among others supported by exemplary embodiments of the present invention. FIG. 11 illustrates plots of characteristic impedance data obtained via laboratory testing of the communication cable. FIG. 12 illustrates plots of propagation delay data obtained via laboratory testing of the communication cable. FIG. 13 illustrates plots of propagation delay skew obtained via laboratory testing of the communication cable.

The engineering details and performance results illustrated in FIGS. 5, 6, 7, 8, 9, 10, 11, and 12 in combination with the foregoing discussion and figures describe how the present technology can support elevated signal performance while providing benefits in reduced material consumption leading to cost savings.

From the foregoing, it will be appreciated that an embodiment of the present invention overcomes the limitations of the prior art. Those skilled in the art will appreciate that the present invention is not limited to any specifically discussed application and that the embodiments described herein are illustrative and not restrictive. From the description of the exemplary embodiments, equivalents of the elements shown therein will suggest themselves to those skilled in the art, and ways of constructing other embodiments of the present invention will suggest themselves to practitioners of the art. Therefore, the scope of the present invention is to be limited only by the claims that follow.

What is claimed is:

1. A communication cable comprising:

an outer jacket covering four pairs of individually insulated electrical conductors extending lengthwise, wherein each pair is twisted to a different lay length, and wherein the insulation of each pair is foamed to a different level that decreases with increasing lay length; and a flexible member extending lengthwise and disposed between at least two of the pairs, the flexible member operative to maintain the pairs in a predetermined configuration.

2. The communication cable of claim 1, wherein each of the electrical conductors has a common diameter.

3. The communication cable of claim 1, wherein the insulation of each pair has a common composition.

4. The communication cable of claim 1, wherein the insulation of each pair has a common melting point.

5. The communication cable of claim 1, wherein the insulation of each pair comprises a respective skin.

6. The communication cable of claim 1, wherein the different lay lengths are operative to reduce interference.

7. The communication cable of claim 6, wherein the different levels of foaming are operative to provide substantially uniform propagation speed among the pairs.

8. The communication cable of claim 7, wherein the different levels of foaming are operative to provide substantially uniform attenuation among the pairs.

9. The communication cable of claim 1, wherein the different levels of foaming are operative to balance electrical properties among the pairs.

10. The communication cable of claim 1, wherein the four pairs are circumferentially arranged about a longitudinal axis of the communication cable such that pairs circumferentially adjacent one another have greater difference in lay length than pairs disposed opposite one another with respect to the longitudinal axis.

11. The communication cable of claim 1, wherein a first of the four pairs is twisted in a clockwise direction and a second of the four pairs is twisted in a counterclockwise direction.

12. A communication cable, comprising:

a jacket defining an interior space that extends lengthwise about a longitudinal axis of the communication cable;

a first plurality of electrical signal conductors that are individually insulated with a polymeric material foamed to a first level and that are twisted together to provide a first twist length;

a second plurality of electrical signal conductors that are individually insulated with the polymeric material foamed to a second level that is substantially lower than the first level and that are twisted together to provide a second twist length that is substantially longer than the first twist length; and a flexible member disposed in the interior space between the first plurality of electrical signal conductors and the second plurality of electrical signal conductors, the flexible member operative to maintain the first plurality of electrical signal conductors and the second plurality of electrical signal conductors in a predetermined configuration.

13. The communication cable of claim 12, wherein a difference between the first level and the second level is correlated with a difference between the first length and the second length.

14. The communication cable of claim 12, wherein the first level and the second level are operative to balance electrical performance between the first plurality of electrical signal conductors and the second plurality of electrical signal conductors.

15. The communication cable of claim 12, wherein the first level and the second level are operative to compensate for twist length difference between the first plurality of electrical signal conductors and the second plurality of electrical signal conductors.

16. The communications cable of claim 12, wherein each of the first plurality of electrical signal conductors is insulated to a substantially common outer diameter, and wherein each of the second plurality of electrical signal conductors is insulated to the substantially common outer diameter.

17. The communication cable of claim 12, wherein the first plurality of electrical signal conductors is twisted in a clockwise direction and the second plurality of electrical signal conductors is twisted in a counterclockwise direction.

18. A communication cable comprising an outer jacket extending lengthwise and circumferentially covering:

a first pair of electrical conductors twisted to a first lay length;

a second pair of electrical conductors twisted to a second lay length that is longer than the first lay length;

a third pair of electrical conductors twisted to a third lay length that is longer than the second lay length; and a fourth pair of electrical conductors twisted to a fourth lay length that is longer than the third lay length, wherein the electrical conductors of the first pair are insulated with a polymer foamed to a first level, wherein the electrical conductors of the second pair are insulated with the polymer foamed to a second level that is less than the first level, wherein the electrical conductors of the third pair are insulated with the polymer foamed to a third level that is less than the second level, wherein the electrical conductors of the fourth pair are insulated with the polymer foamed to a fourth level that is less than the third level, and wherein the first pair, the second pair, the third pair, and the fourth pair are circumferentially arranged about a longitudinal axis of the communication cable such that pairs circumferentially adjacent one another have greater difference in lay length than pairs disposed opposite one another with respect to the longitudinal axis.

19. The communication cable of claim 18, wherein the respective electrical conductors of each of the first, second, third, and fourth pairs are further insulated with a skin comprising the polymer.

20. The communication cable of claim 18, wherein the respective electrical conductors of each of the first pair, the second pair, the third pair, and the fourth pair have common diameters.

21. The communication cable of claim 18, wherein the electrical conductors of each of the first pair, the second pair, the third pair, and the fourth pair are insulated to a common outer diameter.

22. The communication cable of claim 18, wherein each of the electrical conductors of the first pair, the second pair, the thud pan, and the fourth pair is insulated to a substantially consistent outer diameter.

23. The communication cable of claim 18, wherein the first level, the second level, the third level, and the fourth level are selected to meet a cable performance specification.

24. The communication cable of claim 18, further comprising:

a flexible member extending lengthwise and disposed between at least two of the first pair, the second pair, the third pair, and the fourth pair, the flexible member operative to maintain the pairs in a predetermined configuration.

25. The communication cable of claim 18, wherein one of the first pair, the second pair, the third pair, and the fourth pair is twisted in a clockwise direction and another of the first pair, the second pair, the third pair, and the fourth pair is twisted in a counterclockwise direction.

* * * * *